US008703445B2

(12) United States Patent
Collier et al.

(10) Patent No.: US 8,703,445 B2
(45) Date of Patent: Apr. 22, 2014

(54) MOLECULAR DIAGNOSTICS AMPLIFICATION SYSTEM AND METHODS

(75) Inventors: Gordon Bruce Collier, Fitzroy Harbour (CA); Jason Andrew MacLeod, Ottawa (CA); Attila Csaba Nemeth, Ottawa (CA); William Charles Dicke, Ottawa (CA)

(73) Assignee: Abbott Point of Care Inc., Princeton, NJ (US)

( * ) Notice: Subject to any disclaimer, the term of this patent is extended or adjusted under 35 U.S.C. 154(b) by 588 days.

(21) Appl. No.: 11/611,677

(22) Filed: Dec. 15, 2006

(65) Prior Publication Data

US 2007/0154922 A1 Jul. 5, 2007

Related U.S. Application Data

(60) Provisional application No. 60/754,266, filed on Dec. 29, 2005.

(51) Int. Cl.

| | |
|---|---|
| ***C12P 19/34*** | (2006.01) |
| ***C12M 1/00*** | (2006.01) |
| ***C12M 3/00*** | (2006.01) |

(52) U.S. Cl.
USPC ..... 435/91.2; 435/289.1

(58) Field of Classification Search
USPC ..... 422/50, 417, 420, 430, 68.1, 69, 500, 422/502, 129, 131, 138; 435/6.1, 6.11, 435/6.12, 91.2, 283.1, 289.1
See application file for complete search history.

(56) References Cited

U.S. PATENT DOCUMENTS

| | | | | |
|---|---|---|---|---|
| 3,938,898 | A * | 2/1976 | Reitknecht | 401/183 |
| 4,387,725 | A * | 6/1983 | Mull | 600/572 |
| 4,683,195 | A | 7/1987 | Mullis et al. | |
| 4,840,893 | A | 6/1989 | Hill et al. | |
| 4,876,187 | A | 10/1989 | Duck et al. | |
| 4,954,087 | A | 9/1990 | Lauks et al. | |
| 5,063,081 | A | 11/1991 | Cozzette et al. | |
| 5,096,669 | A | 3/1992 | Lauks et al. | |
| 5,200,051 | A | 4/1993 | Cozzette et al. | |
| 5,333,675 | A | 8/1994 | Mullis et al. | |
| 5,447,440 | A | 9/1995 | Davis et al. | |
| 5,466,575 | A | 11/1995 | Cozzette et al. | |
| 5,525,494 | A | 6/1996 | Newton | |
| 5,527,670 | A | 6/1996 | Stanley | |
| 5,554,339 | A | 9/1996 | Cozzette et al. | |
| 5,607,832 | A | 3/1997 | Stanley et al. | |
| 5,609,824 | A | 3/1997 | Lauks et al. | |
| 5,639,423 | A | 6/1997 | Northrup et al. | |
| 5,645,801 | A | 7/1997 | Bouma et al. | |
| 5,656,430 | A | 8/1997 | Chirikjian et al. | |
| 5,656,493 | A | 8/1997 | Mullis et al. | |
| 5,660,988 | A | 8/1997 | Duck et al. | |
| 5,725,831 | A * | 3/1998 | Reichler et al. | 422/56 |
| 5,763,178 | A | 6/1998 | Chirikjian et al. | |
| 5,807,527 | A | 9/1998 | Burgoyne | |
| 5,814,450 | A | 9/1998 | Stanley et al. | |
| 5,824,477 | A | 10/1998 | Stanley | |
| 5,837,454 | A | 11/1998 | Cozzette et al. | |
| 5,837,466 | A | 11/1998 | Lane et al. | |
| 5,854,033 | A | 12/1998 | Lizardi | |
| 5,939,312 | A | 8/1999 | Baier et al. | |
| 5,945,286 | A | 8/1999 | Krihak et al. | |
| 5,952,172 | A | 9/1999 | Meade et al. | |
| 5,976,336 | A | 11/1999 | Dubrow et al. | |
| 6,054,277 | A | 4/2000 | Furcht et al. | |
| 6,168,922 | B1 | 1/2001 | Harvey et al. | |
| 6,197,508 | B1 | 3/2001 | Stanley | |
| 6,277,576 | B1 | 8/2001 | Meade et al. | |
| 6,303,288 | B1 | 10/2001 | Furcht et al. | |
| 6,346,387 | B1 | 2/2002 | Stewart et al. | |
| 6,372,484 | B1 | 4/2002 | Ronchi et al. | |
| 6,379,929 | B1 | 4/2002 | Burns et al. | |
| 6,391,558 | B1 | 5/2002 | Henkens et al. | |
| 6,436,355 | B1 | 8/2002 | Lee et al. | |
| 6,440,725 | B1 | 8/2002 | Pourahmadi et al. | |
| RE37,891 | E | 10/2002 | Collins et al. | |
| 6,485,915 | B1 | 11/2002 | Keller et al. | |
| 6,589,742 | B2 | 7/2003 | Edman et al. | |

(Continued)

FOREIGN PATENT DOCUMENTS

JP H9-511407 A 11/1997

OTHER PUBLICATIONS

Berney et al., Rapid amplification for the detection of *Mycobacterium tuberculosis* using a non-contact heating method in a silicon microreactor based thermal cycler, Sensors and Actuators B 102 (2004) 308-314, Available online Jun. 1, 2004.*

Pierce, Pierce Manufacturer, Material Safety Data Sheet for Surfasil™, all pages, 2007.*

M. Vincent, et al., "Helicase-dependent isothermal DNA amplification", European Molecular Biology Organization (EMBO) Reports, vol. 5, No. 8, (2004), pp. 795-800.

(Continued)

*Primary Examiner* — Ardin Marschel

(57) ABSTRACT

The present invention relates to automated devices and methods for the amplification of segments of nucleic acid in a convenient and portable manner. A single-use nucleic acid amplification device for producing an amplicon includes a housing and an amplification chamber. The chamber includes an ingress with a first reversible seal, an egress with a second reversible seal, a sealable sample entry orifice, and a first wall forming a portion of the chamber. The first wall includes a thermally conductive material and includes an interior surface and an exterior surface. The exterior surface includes a heating circuit and a temperature sensor. The sample entry orifice permits a sample of nucleic acid to enter the amplification chamber. The ingress is connected to a first conduit along with a pneumatic pump and a fluid pouch. The egress is connected to a second conduit permitting egress of the amplicon from the amplification chamber.

19 Claims, 15 Drawing Sheets

(56) References Cited

U.S. PATENT DOCUMENTS

| | | | | |
|---|---|---|---|---|
| 6,660,517 | B1 * | 12/2003 | Wilding et al. | 435/289.1 |
| 6,750,053 | B1 | 6/2004 | Widrig Opalsky et al. | |
| 6,991,898 | B2 * | 1/2006 | O'Connor | 435/4 |
| 2003/0008308 | A1 * | 1/2003 | Enzelberger et al. | 435/6 |
| 2003/0170881 | A1 | 9/2003 | Davis et al. | |
| 2004/0053290 | A1 * | 3/2004 | Terbrueggen et al. | 435/6 |
| 2004/0058378 | A1 | 3/2004 | Kong et al. | |
| 2004/0110167 | A1 | 6/2004 | Gerdes et al. | |
| 2005/0202504 | A1 | 9/2005 | Anderson et al. | |
| 2005/0221377 | A1 | 10/2005 | Ibrahim | |
| 2005/0255516 | A1 | 11/2005 | McMillan et al. | |

OTHER PUBLICATIONS

J. Zhang, et al., "Different Applications of Polymerases With and Without Proofreading Activity in Single-Nucleotide Polymorphism Analysis", Laboratory Investigation, vol. 83, No. 8, (2003), pp. 1147-1154.

E. Lagally, et al., "Fully integrated PCT-capillary electrophoresis microsystem for DNA analysis", Lab on a Chip, vol. 1, (2001), pp. 102-107.

J. Sambrook, et al., "Molecular Cloning: A Laboratory Manual", vol. 1, Third Edition, (2001), pp. 5.40-5.48, 8.1-8.24, A1.17-A1.19, and A1.25-A1.27.

E. Lagally, et al., "Single-Molecule DNA Amplification and Analysis in an Integrated Microfluidic Device", Analytical Chemistry, vol. 73, No. 3, (2001), pp. 565-570.

A. Hühmer, et al., "Noncontact Infrared-Mediated Thermocycling for Effective Polymerase Chain Reaction Amplification of DNA in Nanoliter Volumes", Analytical Chemistry, vol. 72, No. 21, (2000), pp. 5507-5512.

M. Takagi, et al., "Characterization of DNA Polymerase from *Pyrococcus* sp. Strain KOD1 and Its Application to PCR", Applied and Environmental Microbiology, vol. 63, No. 11, (1997), pp. 4504-4510.

R. Anderson, et al., "Microfluidic Biochemical Analysis System", Transducers, 1997 International Conference on Solid-State Sensors and Actuators, Jun. 16-19, 1997, pp. 477-480.

C. Newton, et al., "The production of PCR products with 5' single-stranded tails using primers that incorporate novel phosphoramidite intermediates", Nucleic Acids Research, vol. 21, No. 5, (1993), pp. 1155-1162.

International Search Report and Written Opinion received in the corresponding International Application No. PCT/US2006/047754.

Reasons for Rejection regarding Japanese Patent Application No. 2008-548567, mailed Jun. 27, 2012.

* cited by examiner

041221 PCR Cycle Number on polyacrylamide gel.
Negative image of digital photo. SYBR Gold DNA stain.
10% non-denaturing gel.
6ul PCR sample + 1.6ul loading dye → loaded 6ul/well

MOLECULAR DIAGNOSTICS AMPLIFICATION SYSTEM AND METHODS

This application claims priority under 35 U.S.C. §119(e) to U.S. Provisional Application No. 60/754,266, filed on Dec. 29, 2005, the entire contents of which are hereby incorporated by reference herein.

BACKGROUND

1. Field of the Invention

The present invention relates to an integrated nucleic acid test cartridge capable of performing amplification based on temperature cycling and isothermal methods. Furthermore, it relates to devices and methods for receiving a sample suspected of containing a nucleic acid target, performing amplification and transferring an amplicon for detection. The amplification cartridge can be equipped with a sensing means including at least optical and electrochemical sensors. The cartridge can perform various methods of amplification including, but not limited to, polymerase chain reaction, rolling circle amplification and strand displacement amplification. The amplification device also has the ability to function with a portable power supply or means therefor.

2. Background Information

Applications of nucleic acid testing are broad. The majority of conventional commercial testing relates to infectious diseases including Chlamydia, gonorrhea, hepatitis and human immunodeficiency virus (HIV) viral load; genetic diseases including cystic fibrosis; coagulation and hematology factors including hemochromatosis; and cancer including genes for breast cancer. Other areas of interest include forensics and paternity testing, cardiovascular diseases and drug resistance screening, termed pharmacogenomics. The majority of testing currently occurs in centralized laboratories using non-portable and operationally complex instruments. Conventionally, tests generally require highly skilled individuals to perform the assays. As a result, the time taken between obtaining a sample suspected of containing a specific nucleic acid fragment and determining its presence or absence is often several hours and even days. However, as with other kinds of blood tests, physicians and scientists often require results more quickly and that are obtainable in a convenient user-friendly format. Consequently, there is a need for a portable analysis system capable of performing nucleic acid testing quickly and conveniently.

Methods of extracting nucleic acids from cells are well known to those skilled in the art. A cell wall can be weakened by a variety of methods, permitting the nucleic acids to extrude from the cell and permitting its further purification and analysis. The specific method of nucleic acid extraction is dependent on the type of nucleic acid to be isolated, the type of cell, and the specific application used to analyze the nucleic acid. Many methods of isolating DNA are known to those skilled in the art, as described in, for example, the general reference Sambrook and Russell, 2001, "Molecular Cloning: A Laboratory Manual," pages 5.40-5.48, 8.1-8.24, A1.17-A1.19, and A1.25-A1.27. For example, conventional techniques can include chemically-impregnated and dehydrated solid-substrates for the extraction and isolation of DNA from bodily fluids that employ lytic salts and detergents and that contain additional reagents for long-term storage of DNA samples, as described in, for example, U.S. Pat. No. 5,807,527 (detailing FTA paper), and U.S. Pat. No. 6,168,922 (detailing Isocard Paper). Conventional techniques can also include particle separation methods, such as those described in, for example, U.S. Reissue Pat. No. RE37,891.

Several methods and apparatuses for amplification of nucleic acid are known to those of ordinary skill in the art. It is known that Polymerase Chain Reaction (PCR) is inhibited by a number of proteins and other contaminants that follow through during the standard methods of purification of genomic DNA from a number of types of tissue samples. It is known that additional steps of organic extraction with phenol, chloroform and ether or column chromatography or gradient CsCl ultracentrifugation can be performed to remove PCR inhibitors in genomic DNA samples from blood. However, these steps add time, complexity and cost. Such complexity has limited development of a simple disposable cartridge useful for nucleic acid analysis. Therefore, the development of new, simple methods to overcome inhibitors found in nucleic acid samples used for nucleic acid amplification processes is desirable.

Nucleic acid hybridization is used to detect discernible characteristics about target nucleic acid molecules. Techniques like the "Southern analysis" are well known to those skilled in the art. Target nucleic acids are electrophoretically separated, then bound to a membrane. Labeled probe molecules are then permitted to hybridize to the nucleic acids bound to the membrane using techniques well known in the art. This method is limited, however, because the sensitivity of detection is dependent on the amount of target material and the specific activity of the probe, and, in the example of a radioactively labeled probe, the time of exposure of the signal to the detection device can be increased. Alternatively, as the probe's specific activity may be fixed, to improve the sensitivity of these assays, methods of amplifying nucleic acids are employed. Two basic strategies are employed for nucleic acid amplification techniques; either the number of target copies is amplified, which in turn increases the sensitivity of detection, or the presence of the nucleic acid is used to increase a signal generated for detection. Examples of the first approach include polymerase chain reaction (PCR), rolling circle (as described in, for example, U.S. Pat. No. 5,854,033), and nucleic acid system based amplification (NASBA). Examples of the second include cycling probe reaction, termed CPR (as described in, for example, U.S. Pat. Nos. 4,876,187 and 5,660,988) and SNPase assays, e.g., the Mismatch Identification DNA Analysis System (as described in, for example, U.S. Pat. Nos. 5,656,430 and 5,763,178). More recently, a strategy for performing the polymerase chain reaction isothermally has been described by Vincent et al., 2004, EMBO Reports, vol 5(8), and is described in, for example, U.S. Application Publication No. 2004/0058378. A DNA helicase enzyme is used to overcome the limitations of heating a sample to perform PCR DNA amplification.

The PCR reaction is well known to those skilled in the art and was originally described in U.S. Pat. No. 4,683,195. The process involves denaturing nucleic acid, a hybridization step and an extension step in repeated cycles, and is performed by varying the temperature of the nucleic acid sample and reagents. This process of subjecting the samples to different temperatures can be effected by placing tubes into different temperature water baths, or by using Peltier-based devices capable of generating heating and cooling, dependent on the direction of the electrical current, as described in, for example, U.S. Pat. Nos. 5,333,675 and 5,656,493. Many commercial temperature cycling devices are available, sold by, for example, Perkin Elmer (Wellesley, Mass.), Applied Biosystems (Foster City, Calif.), and Eppendorf (Hamburg, Germany). As these devices are generally large and heavy, they are not generally amenable to use in non-laboratory environments, such as, for example, at the point-of-care of a patient.

Microfabricated chamber structures for performing the polymerase chain reaction have been described in, for example, U.S. Pat. No. 5,639,423. A device for performing the polymerase chain reaction is described in, for example, U.S. Pat. No. 5,645,801 that has an amplification chamber that can be mated to a chamber for detection. For example, U.S. Pat. No. 5,939,312 describes a miniaturized multi-chamber polymerase chain reaction device. U.S. Pat. No. 6,054,277 describes a silicon-based miniaturized genetic testing platform for amplification and detection. A polymer-based heating component for amplification reactions is described in, for example, U.S. Pat. No. 6,436,355. For example, U.S. Pat. No. 6,303,288 describes an amplification and detection system with a rupturable pouch containing reagents for amplification. U.S. Pat. No. 6,372,484 describes an apparatus for performing the polymerase chain reaction and subsequent capillary electrophoretic separation and detection in an integrated device.

There are several nucleic acid amplification technologies that differ from the PCR reaction in that the reaction is run at a single temperature. These isothermal methods include, for example, the cycling probe reaction, strand displacement, INVADER™ (Third Wave Technologies Inc., Madison, Wis.), SNPase, rolling circle reaction, and NASBA. For example, U.S. Pat. No. 6,379,929 describes a device for performing an isothermal nucleic acid amplification reaction.

A microfluidic biochemical analysis system with flexible valve ports and with pneumatic actuation is described in, for example, Anderson et al., Transducers '97, pages 477-80; 1997 International Conference on Solid-State Sensors and Actuators, Chicago, Jun. 16-19, 1997. A fully integrated PCR-capillary electrophoresis microsystem for DNA analysis is described in, for example, Lagally et al., Lab on a Chip, 1, 102-7, 2001. A method of non-contact infrared-mediated thermocycling for efficient PCR amplification of DNA in nanoliter volumes is described in, for example, Huhmer and Landers, Analytical Chemistry 72, 5507-12, 2000. A single molecule DNA amplification and analysis microfluidic device with a thermocouple and valve manifold with pneumatic connections is described in Lagally et al., Analytical Chemistry 73, 565-70, 2001.

The polymerase chain reaction (PCR) is based on the ability of a DNA polymerase enzyme to exhibit several core features that include its ability to use a primer sequence with a 3'-hydroxyl group and a DNA template sequence and to extend a newly synthesized strand of DNA using the template strand, as is well known to those skilled in the art. In addition, DNA polymerases used in the PCR reaction must be able to withstand high temperatures (e.g., 90 to 99° C.) used to denature double stranded DNA templates, as well as be less active at lower temperatures (e.g., 40 to 60° C.) at which DNA primers hybridize to the DNA template. Furthermore, it is necessary to have optimal DNA synthesis at a temperature at or above to the hybridization temperature (e.g., 60 to 80° C.).

Zhang et al. (2003, Laboratory Investigation, vol 83(8): 1147) describe the use of a terminal phosphorothioate bond to overcome the limitations of DNA polymerases used for 3'-5' exonuclease activity. The phosphorothioate bond is not cleaved by 3'-5' exonucleases. This prevents DNA polymerases with 3'-5' exonuclease activities from removing the terminal mismatch and proceeding with DNA elongation, alleviating the lack of discrimination observed with normal DNA.

Another characteristic of DNA polymerases is their elongation rate. Takagi et al. (1997, Applied and Environmental Microbiology, vol 63(11): 4504) describes that *Pyrococcus* sp. Strain KOD1 (now *Thermococcus kodakaraensis* KOD1), *Pyrococcus furiosus*, Deep Vent (New England Biolabs, Beverly, Mass.), and *Thermus aquaticus* have elongation rates of 106 to 138, 25, 23 and 61 bases/second, respectively. The processivity rates of these enzymes are also described, and behave similarly to the elongation rates. Clearly, *Thermococcus kodakaerensis* KOD1 has much higher elongation and processivity rates compared to the other well known enzymes that would make this enzyme beneficial in applications where sensitivity and speed are an issue. Further, *Thermococcus kodakaerensis* KOD 1 possesses an exonuclease activity that would be detrimental for use in a 3'-allele specific primer extention assay used for SNP analysis.

Conventional detection methods for the final step in a nucleic acid analysis are well known in the art, and include sandwich-type capture methods based on radioactivity, colorimetry, fluorescence, fluorescence resonance energy transfer (FRET) and electrochemistry. For example, jointly-owned U.S. Pat. No. 5,063,081 (the '081 patent) covers a sensor for nucleic acid detection. The sensor has a permselective layer over an electrode and a proteinaceous patterned layer with an immobilized capture oligonucleotide. The oligonucleotide can be a polynucleotide, DNA, RNA, active fragments or subunits or single strands thereof. Coupling means for immobilizing nucleic acids are described along with methods where an immobilized nucleic acid probe binds to a complimentary target sequence in a sample. Detection is preferably electrochemical and is based on a labeled probe that also binds to a different region of the target. Alternatively, an immobilized antibody to the hybrid formed by a probe and polynucleotide sequence can be used along with DNA binding proteins. The '081 patent incorporates by reference the jointly owned U.S. Pat. No. 5,096,669 that is directed to a single-use cartridge for performing assays in a sample using sensors. These sensors can be of the type described in the '081 patent.

Other divisional patents related to the '081 patent include, for example, U.S. Pat. No. 5,200,051 that is directed to a method of making a plurality of sensors with a permselective membrane coated with a ligand receptor that can be a nucleic component. For example, U.S. Pat. No. 5,554,339 is directed to microdispensing, where a nucleic acid component is incorporated into a film-forming latex or a proteinaceous photoformable matrix for dispensing. U.S. Pat. No. 5,466,575 is directed to methods for making sensors with the nucleic component incorporated into a film-forming latex or a proteinaceous photoformable matrix. U.S. Pat. No. 5,837,466 is directed to methods for assaying a ligand using the sensor components including nucleic components. For example, a quantitative oligonucleotide assay is described where the target binds to a receptor on the sensor and is also bound by a labeled probe. The label is capable of generating a signal that is detected by the sensor, e.g., an electrochemical sensor. For example, U.S. Pat. No. 5,837,454 is directed to a method of making a plurality of sensors with a permselective membrane coated with a ligand receptor that can be a nucleic component. Finally, jointly-owned U.S. Pat. No. 5,447,440 is directed to a coagulation affinity-based assay applicable to nucleotides, oligonucleotides or polynucleotides. Each of the aforementioned jointly-owned patents are incorporated by reference herein in their entireties.

It is noteworthy that jointly-owned U.S. Pat. No. 5,609,824 teaches a thermostated chip for use within a disposable cartridge applicable to thermostating a sample, e.g., blood, to 37° C. Jointly-owned U.S. Pat. No. 6,750,053 and U.S. Application Publication No. 2003/0170881 address functional fluidic elements of a disposable cartridge relevant to various tests including DNA analyses. These additional jointly-owned patents and applications are incorporated by reference herein in their entireties.

Several other patents address electrochemical detection of nucleic acids. For example, U.S. Pat. No. 4,840,893 teaches detection with an enzyme label that uses a mediator, e.g., ferrocene. U.S. Pat. No. 6,391,558 teaches single stranded DNA on the electrode that binds to a target, where a reporter group is detected by the electrode towards the end of a voltage pulse and uses gold particles on the electrode and biotin immobilization. For example, U.S. Pat. No. 6,346,387 is directed to another mediator approach, but with a membrane layer over the electrode through which a transition metal mediator can pass. U.S. Pat. No. 5,945,286 is based on electrochemistry with intercalating molecules. For example, U.S. Pat. No. 6,197,508 teaches annealing single strands of nucleic acid to form double strands using a negative voltage followed by a positive voltage. Similar patents include, for example, U.S. Pat. Nos. 5,814,450, 5,824,477, 5,607,832, and 5,527,670 that teach electrochemical denaturation of double stranded DNA. U.S. Pat. Nos. 5,952,172 and 6,277,576 teach DNA directly labeled with a redox group.

Several patents address devising cartridge-based features or devices for performing nucleic acid analyses. Such patents include, for example, a denaturing device described in U.S. Pat. No. 6,485,915, an integrated fluid manipulation cartridge described in U.S. Pat. No. 6,440,725, a microfluidic system described in U.S. Pat. No. 5,976,336 and a microchip for separation and amplification described U.S. Pat. No. 6,589,742.

Based on the forgoing description, there remains a need for a convenient and portable analysis system capable of performing nucleic acid amplification and testing.

SUMMARY OF THE INVENTION

An object of the present invention is to provide an integrated nucleic acid test cartridge capable of amplification.

A further object of the present invention is to provide an integrated nucleic acid test cartridge capable of performing extraction and amplification in a single chamber.

Another object of the present invention is to provide an integrated nucleic acid test cartridge capable of performing amplification and transferring an amplicon for detection.

A further object of the present invention is to provide an integrated cartridge for nucleic acid amplification that operates in conjunction with a controlling instrument.

An object of the present invention is to provide an integrated nucleic acid testing system and method suitable for analyses performed at the bedside, in the physician's office and other locations remote from a laboratory environment where testing is traditionally performed. The present invention particularly addresses expanding opportunities for point-of-care diagnostic testing, i.e., testing that is rapid, inexpensive and convenient using small volumes of accessible bodily fluids such as, for example, blood and buccal cells.

Another object of the present invention to provide a means of performing a DNA amplification reaction using a portable power supply, including using batteries or solar power.

Exemplary embodiments of the present invention provide a single-use nucleic acid amplification device for producing an amplicon comprising: a housing, an amplification chamber comprising an ingress with a reversible seal, an egress with a reversible seal, a sealable sample entry orifice and a first wall forming a portion of the chamber, where the first wall comprises a thermally conductive material having a first (e.g., interior) surface and a second (e.g., exterior) surface, where the exterior surface has a heating circuit and a temperature sensor, where the sample entry orifice permits a sample of nucleic acid to enter the chamber, where the ingress is connected to a conduit with a pneumatic pump means and a fluid pouch, where the egress is connected to a conduit permitting egress of the amplicon from the chamber. In one exemplary embodiment of the present invention, the pump means can comprise a flexible diaphragm capable of engaging and being actuated by a plunger on an instrument with which the device is capable of mating. In another exemplary embodiment, the pump means can comprise a flexible diaphragm capable of manual actuation. The above-mentioned fluid pouch can contain a fluid, including, but not limited to, a fluid for performing a nucleic acid amplification. Optionally, the fluid pouch can further contain one or more reagents selected from the group consisting of deionized water, a buffer material, dNTPs, one or more primers and a polymerase.

According to one exemplary embodiment of the amplification chamber of the present invention, the first wall can comprise silicon. Optionally, a second wall can comprise a plastic material. Preferably, the second wall comprising a plastic material has a wall thickness in the range of about 0.2 mm to about 5 mm, with one or more additional and optional rib supports. In a preferred exemplary embodiment of the chamber of the present invention, the first wall comprising silicon takes up about 30 to about 50 percent of the interior surface area of the chamber. More preferably, the internal volume of the chamber can be in the range of about 5 uL to about 50 uL. The ratio of the chamber surface to the chamber volume can vary widely. In a particular exemplary embodiment of the present invention, the chamber surface can range from about 50 to about 200 $mm^2$ compared with a chamber volume that ranges from about 5 to about 30 $mm^3$. The amplification chamber can have a variety of internal shapes. Suitable shapes can include, but are not limited to, a substantially rectangular structure, a substantially rectangular shape with rounded corners, a cylinder, a cylindrical structure with a substantially oval cross-section, and other like shapes.

According to an exemplary embodiment, the exterior surface of the first wall includes a heating circuit comprising a resistive electrical path fabricated on the surface with a first and second connecting pad for contacting an external circuit for providing current flow through the path. Moreover, the exterior surface of the first wall can be equipped with a temperature sensor comprising, for example, a thermistor or thermocouple fabricated on the surface and further equipped with first and second connecting pads for contacting an external circuit for electrical connection with the thermistor or thermocouple.

As described further herein, the sample entry orifice of the inventive device is capable of mating with a sample introduction element comprising a wand with a first end with an absorbent pad capable of collecting and retaining a nucleic acid sample and a second end forming a handle. The first end is capable of passing through the sample entry orifice into the chamber, where the wand has an engaging means between the first and second end for engaging and sealing the wand in the sample entry orifice.

According to a preferred exemplary embodiment of the present invention, the amplification chamber contains a polymerase and dNTPs, optionally, one or more primers and/or buffers. The amplification chamber can further contain a sugar glass coating on at least a portion of the interior surface of the first wall. The sugar glass coating can comprise a reagent selected from the group consisting of a buffer, a dye, one or more primers and a polymerase. The amplification chamber is preferably capable of withstanding a temperature increase ramp rate in the range of about 10 to about 50° C. per second, more preferably, about 4 to about 50° C. per second. The amplification chamber can further comprise an optical window.

It should be noted that the inventive device is capable of engaging and being operated by an instrument, preferably a hand-held instrument. Such an instrument can be equipped with a fan that is capable of cooling the amplification chamber. Alternatively, the instrument can include a heat-sink capable of reversibly contacting and cooling the amplification chamber. What is more, the exterior surface of the first wall can include a Peltier circuit with a first and second connecting pad for contacting an external circuit.

The inventive device according to exemplary embodiments is preferably equipped with a reversible seal on the ingress. The reversible seal can comprise a flexible diaphragm. The flexible diaphragm can be capable of actuation into a closed position by an applied force, and an open position by the absence of the applied force. For instance, the applied force can be provided by another device, for example, an instrument with which the inventive device is engaged, which instrument might be equipped with a pin that can mate with the flexible diaphragm. The inventive device can also be equipped with a reversible seal on the egress. The reversible seal can comprise a flexible diaphragm. Such a flexible diaphragm can be capable of actuation into a closed position by an applied force, and an open position by the absence of the applied force. For instance, the applied force can be provided by another device, for example, an instrument with which the inventive device is engaged, which instrument might be equipped with a pin that can mate with the flexible diaphragm.

According to an exemplary embodiment, the inventive device can include a conduit that is capable of permitting egress of the amplicon, and which has a mating feature for engaging a separate device for detection of the amplicon. In one exemplary embodiment, the ingress and the egress are at opposite corners of the amplification chamber.

A sample entry orifice is also provided with the inventive device that is capable of mating with a sample introduction element. The sample introduction element can comprise, for example, a wand that, in turn, can comprise a first end with an absorbent pad capable of collecting and retaining a nucleic acid sample and a second end forming a handle. The first end can be capable of passing through the aforementioned sample entry orifice into the amplification chamber. Furthermore, the wand can include an engaging means between the first and second end for engaging and sealing the wand in the sample entry orifice. In a preferred exemplary embodiment, the engaging and sealing means can comprise a male screw feature on the wand and a female screw feature on the sample entry orifice. In another exemplary embodiment, the engaging and sealing means can comprise a male collar locking feature on the wand and a female collar locking feature on the sample entry orifice.

In yet another exemplary embodiment of the present invention, the conduit connected to the ingress can further comprise a chip insert equipped with a fluid detection sensor. In particular, a portion of the chip can be preferably coated with a nucleic acid amplification reagent. A wide variety of nucleic acid amplification reagents can be coated onto a portion of the chip, including, but not limited to, a buffer, a dye, one or more primers, dNTPs, a polymerase, and the like. Nucleic acid amplification reagents can also be coated elsewhere in the inventive device, such as the conduit connected to the ingress.

Therefore, a combination is also contemplated and provided by the present invention, which combination includes a single-use nucleic acid amplification device for producing an amplicon and an instrument for engaging and operating this device. Preferably, such device comprises a housing, an amplification chamber comprising an ingress with a reversible seal, an egress with a reversible seal, a sealable sample entry orifice, and a first wall forming a portion of the amplification chamber. The first wall comprises a thermally conductive material having an interior surface and an exterior surface, wherein the exterior surface has a heating circuit and a temperature sensor. The sample entry orifice permits a sample of nucleic acid to enter the amplification chamber. The ingress is connected to a conduit with a pneumatic pump means and a fluid pouch, while the egress is connected to a conduit permitting egress of the amplicon from the chamber.

The instrument, which can be portable and battery powered, is equipped with a recess for receiving and engaging the device. Moreover, the instrument can be further equipped with electrical connector means for contacting the heating circuit and the temperature sensor. The instrument can also be provided with mechanical connector means for reversibly engaging the ingress seal, the egress seal, the pneumatic pump means and the fluid pouch. In a particular exemplary embodiment of the present invention, the instrument can include a fan for directing an air stream at the thermally conductive exterior wall of the amplification device. Alternatively, the instrument can include a heat sink for making reversible contact with the thermally conductive exterior wall of the amplification device. The instrument can also be equipped with an electrical connector for contacting a Peltier circuit on the thermally conductive exterior wall of the amplification device. An electrical connector provided with the instrument can also be used for contacting a fluid detection sensor in the amplification device.

According to exemplary embodiments, a method is also provided of nucleic acid amplification for producing an amplicon in a single-use device. The method comprises the steps of introducing a nucleic acid sample into an amplification chamber through a sample entry orifice, sealing the orifice, transferring a fluid from a fluid pouch through a reversibly sealable ingress to the amplification chamber, sealing the ingress and an egress of the chamber, mixing the fluid with the sample to form a mixture comprising nucleic acid, buffer, a polymerase and one or more primers, cycling the temperature of the chamber between a first and second temperature for a predetermined time and for a predetermined number of cycles to form an amplicon, opening the ingress and egress of the chamber, and applying a pneumatic force to the ingress to move the amplicon from the chamber through the egress.

Yet another method according to an alternative exemplary embodiment comprises the steps of introducing a nucleic acid sample into an amplification chamber through a sample entry orifice, sealing the orifice, transferring a fluid from a fluid pouch through a reversibly sealable ingress to the amplification chamber, sealing the ingress and an egress of the chamber, mixing the fluid with the sample to form a mixture comprising nucleic acid, buffer, a polymerase and one or more primers, increasing the temperature of the chamber to an isothermal amplification temperature for a predetermined time to form an amplicon, opening the ingress and egress of the chamber, and applying a pneumatic force to the ingress to move the amplicon from the chamber through the egress.

More particularly, according to a first aspect of the present invention, a single-use nucleic acid amplification device for producing an amplicon includes a housing and an amplification chamber. The amplification chamber includes an ingress with a first reversible seal, an egress with a second reversible seal, a sealable sample entry orifice, and a first wall forming a portion of the amplification chamber. The first wall comprises a thermally conductive material and includes a first surface and an second surface. The second surface includes a heating circuit and a temperature sensor. The sample entry orifice is configured to permit a sample of nucleic acid to enter the amplification chamber. The ingress is connected to a first conduit along with a pump and a reservoir. The egress is connected to a second conduit permitting egress of the amplicon from the amplification chamber.

According to the first aspect, the pump can comprise a flexible diaphragm or the like. For example, the flexible diaphragm can be capable of engaging and being actuated by a plunger on an instrument with which the amplification device is capable of mating. Alternatively, the flexible diaphragm is capable of manual actuation. The pump can comprise, for example, a pneumatic pump or other like device or mechanism. The reservoir can comprise, for example, a fluid pouch or the like. The fluid pouch can include a fluid for performing nucleic acid amplification. The fluid pouch can include a fluid for performing a nucleic acid amplification and one or more reagents. Each reagent can comprise at least one of deionized water, a buffer material, dNTPs, one or more primers, and a polymerase. The reservoir can comprise a flexible diaphragm. The flexible diaphragm can be capable of engaging and being actuated by a plunger on an instrument with which the amplification device is capable of mating. Alternatively, the flexible diaphragm can be capable of manual actuation.

According to the first aspect, the first wall can comprise silicon or other like material. For example, the silicon can comprise about 30 to about 50 percent of the first surface area of the amplification chamber. The amplification chamber can comprise a second wall made of a plastic material. For example, the second wall can comprise a wall thickness in the range of about 0.2 mm to about 5 mm, and the second wall can include one or more additional rib supports. The internal volume of the amplification chamber can be in the range of about 5 uL to about 50 uL. The amplification chamber surface to an amplification chamber volume ratio can be in the range of about 50 to about 200 square mm for the amplification chamber surface and to about 5 to about 30 cubic mm for the amplification chamber volume. The internal shape of the amplification chamber can comprise one of a substantially rectangular structure, a substantially rectangular shape with rounded corners, a cylinder, a cylindrical structure with a substantially oval cross-section, and other like structures or configurations. The second surface of the first wall can comprise a heating circuit. The heating circuit can comprise a resistive electrical path fabricated on the second surface with a first and second connecting pad for contacting an external circuit for providing current flow through the path. The second surface of the first wall can comprise a temperature sensor. The temperature sensor can comprise a thermistor or a thermocouple fabricated on the second surface with a first and second connecting pad for contacting an external circuit for connecting to the one of the thermistor and the thermocouple.

According to the first aspect, the sample entry orifice can be capable of mating with a sample introduction element. The sample introduction element can comprise a wand. The wand can comprise a first end with an absorbent pad capable of collecting and retaining a nucleic acid sample. The wand can also comprises a second end forming a handle. The first end can be capable of passing through the sample entry orifice into the amplification chamber. The wand can include an engaging structure between the first and second ends for engaging and sealing the wand in the sample entry orifice. For example, the engaging structure can comprise a male screw structure on the wand and a female screw structure on the sample entry orifice. Alternatively, the engaging structure can comprise a male collar locking structure on the wand and a female collar locking structure on the sample entry orifice. The amplification chamber can contain, for example, a polymerase and dNTPs. Additionally or alternatively, the amplification chamber can contain one or more primers. The amplification chamber can contain a buffer. The amplification chamber can comprise, for example, a sugar glass coating on at least a portion of the first surface of the first wall. The sugar glass coating can comprise a reagent or the like. The reagent can comprise at least one of a buffer, a dye, one or more primers, and a polymerase. The amplification chamber can be capable of a temperature increase ramp rate in the range of about 10 to about 50 degrees centigrade per second. The amplification chamber can be capable of a temperature decrease ramp rate in the range of about 4 to about 50 degrees centigrade per second.

According to the first aspect, the amplification chamber can comprise an optical window. The amplification device can be capable of engaging and being operated by an instrument. For example, the instrument can comprise a fan capable of cooling the amplification chamber. Alternatively, the instrument can comprise a heat-sink capable of contacting and cooling the amplification chamber. The second surface of the first wall can comprise a Peltier circuit or the like with a first and second connecting pad for contacting an external circuit. The first reversible seal can comprise a flexible diaphragm or the like. Such a flexible diaphragm can be capable of actuation into a closed position by an applied force and an open position by the absence of the applied force. The flexible diaphragm can be capable of actuation into a closed position by an applied force provided by an engaged instrument with a pin mating with the flexible diaphragm. The second reversible seal can comprise a flexible diaphragm or the like. Such a flexible diaphragm can be capable of actuation into a closed position by an applied force and an open position by the absence of the applied force. The flexible diaphragm can be capable of actuation into a closed position by an applied force provided by an engaged instrument with a pin mating with the flexible diaphragm.

According to the first aspect, the second conduit can comprise a mating feature for engaging a device for detection of the amplicon. The ingress and the egress can be at substantially opposite corners or ends of the amplification chamber. The first conduit can comprise a chip insert with a fluid detection sensor. A portion of the chip can be coated with a nucleic acid amplification reagent. The nucleic acid amplification reagent can comprise at least one of a buffer, a dye, one or more primers, dNTPs and a polymerase. The first conduit can be coated with a nucleic acid amplification reagent comprising at least one of a buffer, a dye, one or more primers, dNTPs and a polymerase. The first surface can comprise an interior surface, and the second surface can comprise an exterior surface.

According to a second aspect of the present invention, a combination includes a single-use nucleic acid amplification device for producing an amplicon and an instrument for engaging and operating the amplification device. The amplification device includes a housing, and an amplification chamber. The amplification chamber includes an ingress with a first reversible seal, an egress with a second reversible seal, a sealable sample entry orifice, and a first wall forming a portion of the amplification chamber. The first wall comprises a thermally conductive material and includes a first surface and an second surface. The second surface includes a heating circuit and a temperature sensor. The sample entry orifice permits a sample of nucleic acid to enter the amplification chamber. The ingress is connected to a first conduit along with a pump and a reservoir. The egress is connected to a second conduit permitting egress of the amplicon from the amplification chamber. The instrument includes a recess for receiving and engaging the amplification device. The instrument includes electrical connectors for contacting the heating circuit and the temperature sensor, and mechanical connectors for engaging the ingress seal, the egress seal, the pump and the reservoir.

According to the second aspect, the instrument can comprise a fan for directing an air stream at the thermally conductive material of the second surface of the first wall. Alternatively, the instrument can comprise a heat sink for making contact with the thermally conductive material of the second surface of the first wall. The electrical connectors can be capable of contacting a Peltier circuit on the thermally conductive material of the second surface of the first wall. The electrical connectors can be capable of contacting a fluid detection sensor in the amplification device. The instrument can be portable and battery powered. The first surface can comprise an interior surface, and the second surface can comprise an exterior surface. The pump can comprise a pneumatic pump or other like device or mechanism. The reservoir can comprise a fluid pouch or other like means for storing fluid.

According to a third aspect of the present invention, a method of nucleic acid amplification for producing an amplicon in a single-use device includes the steps of: a.) introducing a nucleic acid sample into an amplification chamber through a sample entry orifice; b.) sealing the orifice; c.) transferring a fluid from a reservoir through a reversibly sealable ingress to the amplification chamber; d.) sealing the ingress and an egress of the amplification chamber; e.) mixing the fluid with the sample to form a mixture comprising nucleic acid, a buffer, a polymerase and one or more primers; f.) cycling the temperature of the amplification chamber between first and second temperatures for a predetermined time and for a predetermined number of cycles to form an amplicon; g.) opening the ingress and egress of the chamber; and h.) applying a pneumatic force to the ingress to move the amplicon from the chamber through the egress. According to an exemplary embodiment of the third aspect, the reservoir can comprise, for example, a fluid pouch or the like.

According to a fourth aspect of the present invention, a method of nucleic acid amplification for producing an amplicon in a single-use device includes the steps of: a.) introducing a nucleic acid sample into an amplification chamber through a sample entry orifice; b.) sealing the orifice; c.) transferring a fluid from a reservoir through a reversibly sealable ingress to the amplification chamber; d.) sealing the ingress and an egress of the chamber; e.) mixing the fluid with the sample to form a mixture comprising nucleic acid, a buffer, a polymerase and one or more primers; f.) increasing the temperature of the chamber to an isothermal amplification temperature for a predetermined time to form an amplicon; g.) opening the ingress and the egress of the amplification chamber; and h.) applying a pneumatic force to the ingress to move the amplicon from the chamber through the egress. According to an exemplary embodiment of the fourth aspect, the reservoir can comprise, for example, a fluid pouch or the like.

BRIEF DESCRIPTION OF THE DRAWINGS

Other objects and advantages of the present invention will become apparent to those skilled in the art upon reading the following detailed description of preferred embodiments, in conjunction with the accompanying drawings, wherein like reference numerals have been used to designate like elements, and wherein:

FIG. 7(*a*) illustrates an extra rib support and a fan cooling means. FIG. 7(*b*) illustrates the details of FIG. 7(*a*) wherein a cooling fan and an associated heat sink on the heater chip is used. FIG. 7(*c*) illustrates a cross-sectional view of the silicon chip. FIG. 7(*d*) illustrates the interaction and connections from the amplification device to the silicon chip.

DETAILED DESCRIPTION OF THE PREFERRED EMBODIMENTS

Figure 2:
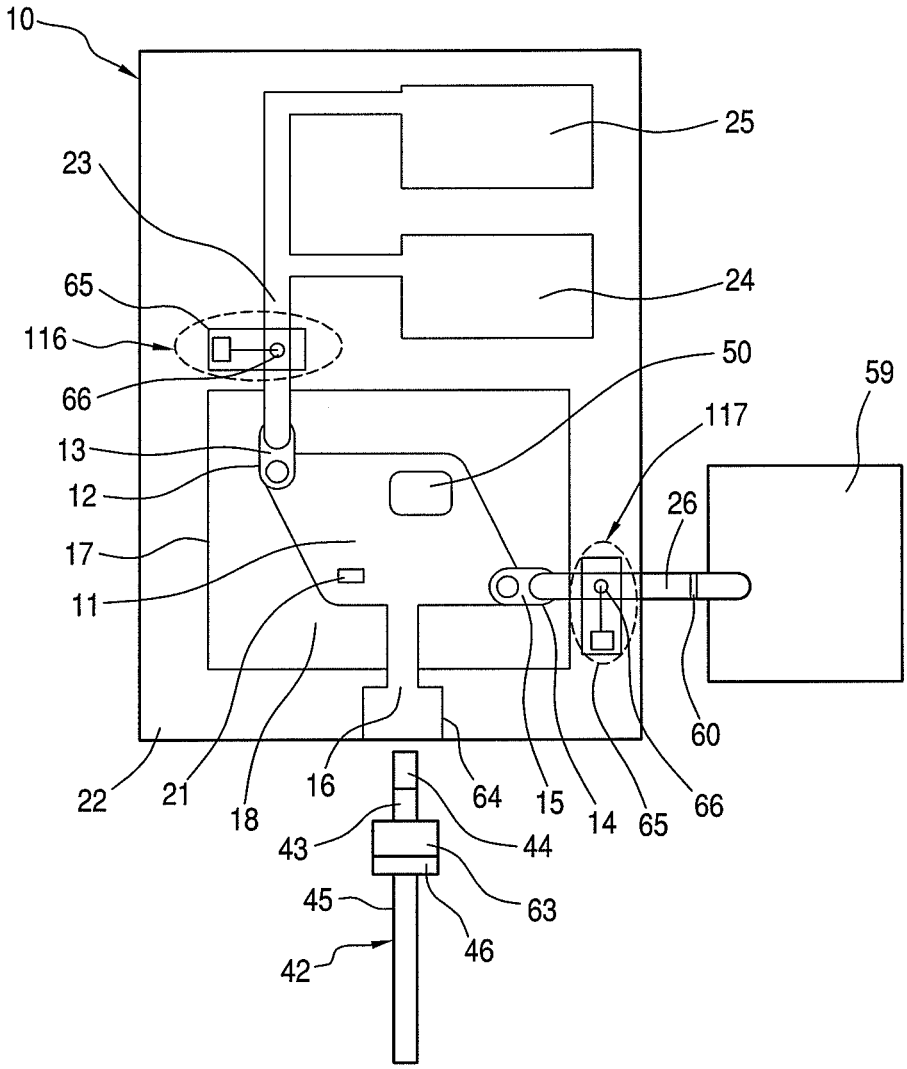
FIG. 2 illustrates a top view of the integrated single-use DNA amplification device, in accordance with an exemplary embodiment of the present invention.

According to an exemplary embodiment of the present invention, the nucleic acid amplification cartridge 10 of FIG. 2 is designed to be single-use and low-cost. Furthermore, it is also disposable in a manner that retains used reagents and patient biological samples safely within the device. The device is capable of producing an amplicon in a manner that is convenient, and can even be used at a point-of-care location outside of a laboratory. The cartridge device comprises a housing that includes an amplification chamber 11 with an ingress 12 with a reversible seal 13, an egress 14 with a reversible seal 15, and also a sealable sample entry orifice 16. The amplification cartridge 10 includes a wall 17 that forms a portion of the chamber 11 that is made of a thermally conductive material, preferably silicon or the like. Alternatively, the wall 17 can be made of alumina, quartz, gallium arsenide, a thermally conductive plastic, and the like. The wall 17 includes an interior surface 18 and an exterior surface 19 (see FIG. 7(*c*)), and on the exterior surface 19 there is a heating circuit 20 (see FIG. 7(*c*)) and a temperature sensor 21. These components are optionally directly fabricated onto the wall surface, such as, for example, by well-known microfabrication techniques where metals are patterned on a silicon wafer surface, by screen printing of a conductive ink, or other like techniques. Where a wafer is used, it can be diced into individual chips and used to form the wall by assembly and adhesion with a second plastic component 22 to form the amplification chamber 11. The sample entry orifice 16 permits a sample of nucleic acid to be introduced into the chamber 11 for amplification.

In one exemplary embodiment, the ingress 12 is connected to a conduit 23 that terminates in a pneumatic pump 24. In another alternative exemplary embodiment, the conduit 23 can also be connected to a fluid pouch 25. As it is usually necessary to remove amplicon from the amplification chamber 11 after the amplification reaction, the egress 14 is connected to a second conduit 26 that permits egress of the amplicon from the chamber 11. These conduits are preferably microfluidic channels formed in one or more injection molded plastic components. Where two or more components are used, they can be assembled together with a double-sided adhesive layer 37 (see FIGS. 7(*a*)-(*b*)), by sonic welding, or the like. The plastic materials are selected to have insignificant reactivity and interference with amplification reagents. The conduits 23, 26 and chamber 11 preferably have a low wet retention, i.e., fluids do not stick to the respective surfaces. Various methods can be used to achieve such an objective, including, for example, judicious materials selection, e.g., plastic and the surface treatments, including hydrophobic coatings such as acetals, polycarbonates, thermal plastics, and surface treatments such as corona treatment.

Figure 1:
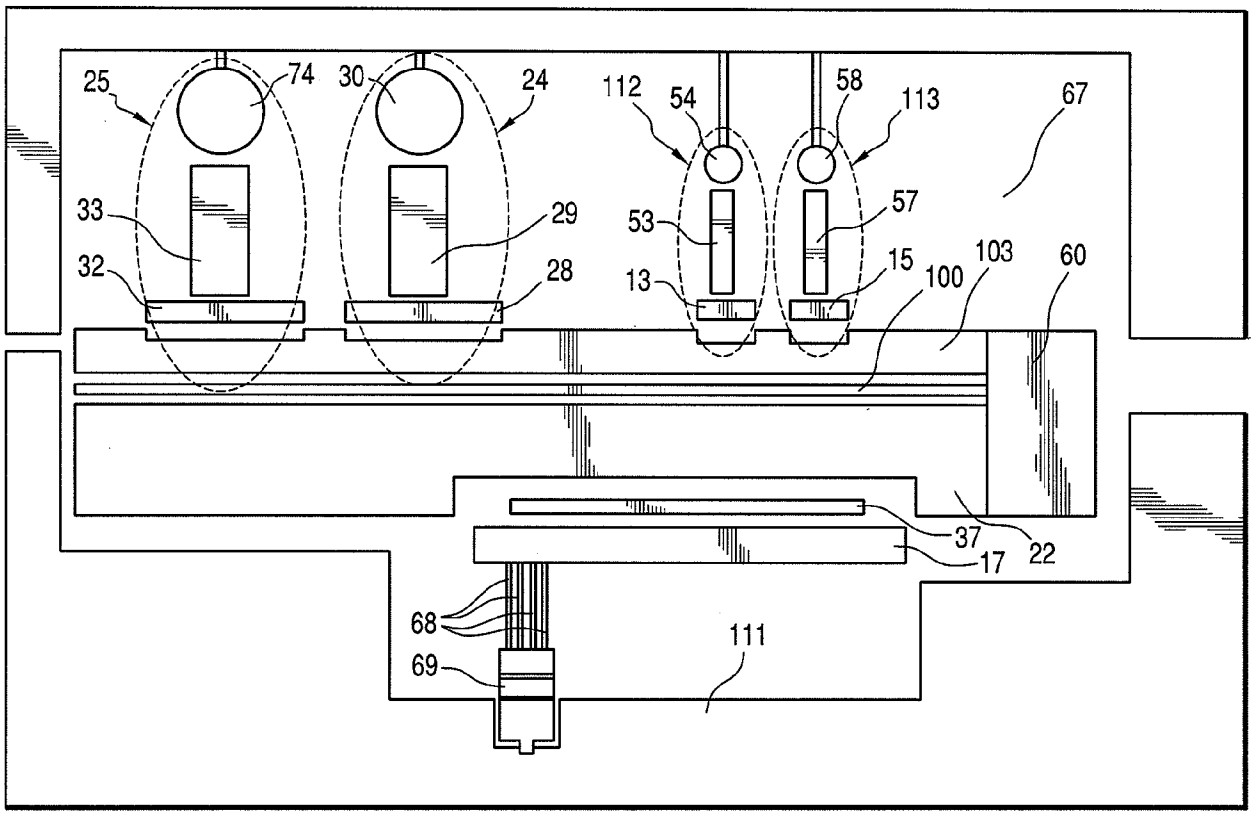
FIG. 1 illustrates a representation of the integrated single-use DNA amplification device and its interaction with an instrument, in accordance with an exemplary embodiment of the present invention.
Figure 3A:
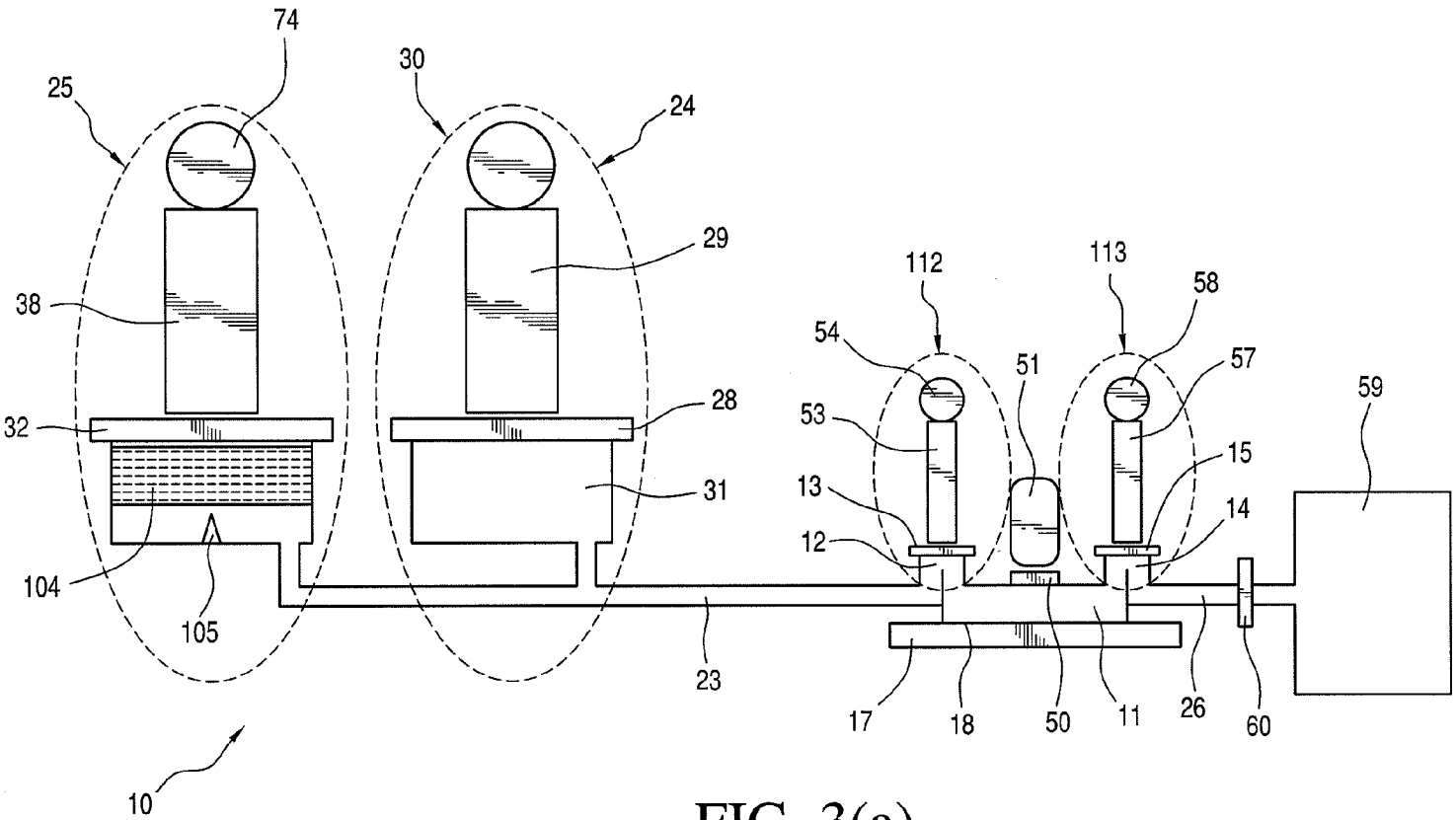
FIGS. 3 (*a*)-(*b*) illustrate different perspectives of the integrated single-use DNA amplification device and its interaction with an instrument, in accordance with an exemplary embodiment of the present invention.
Figure 3B:
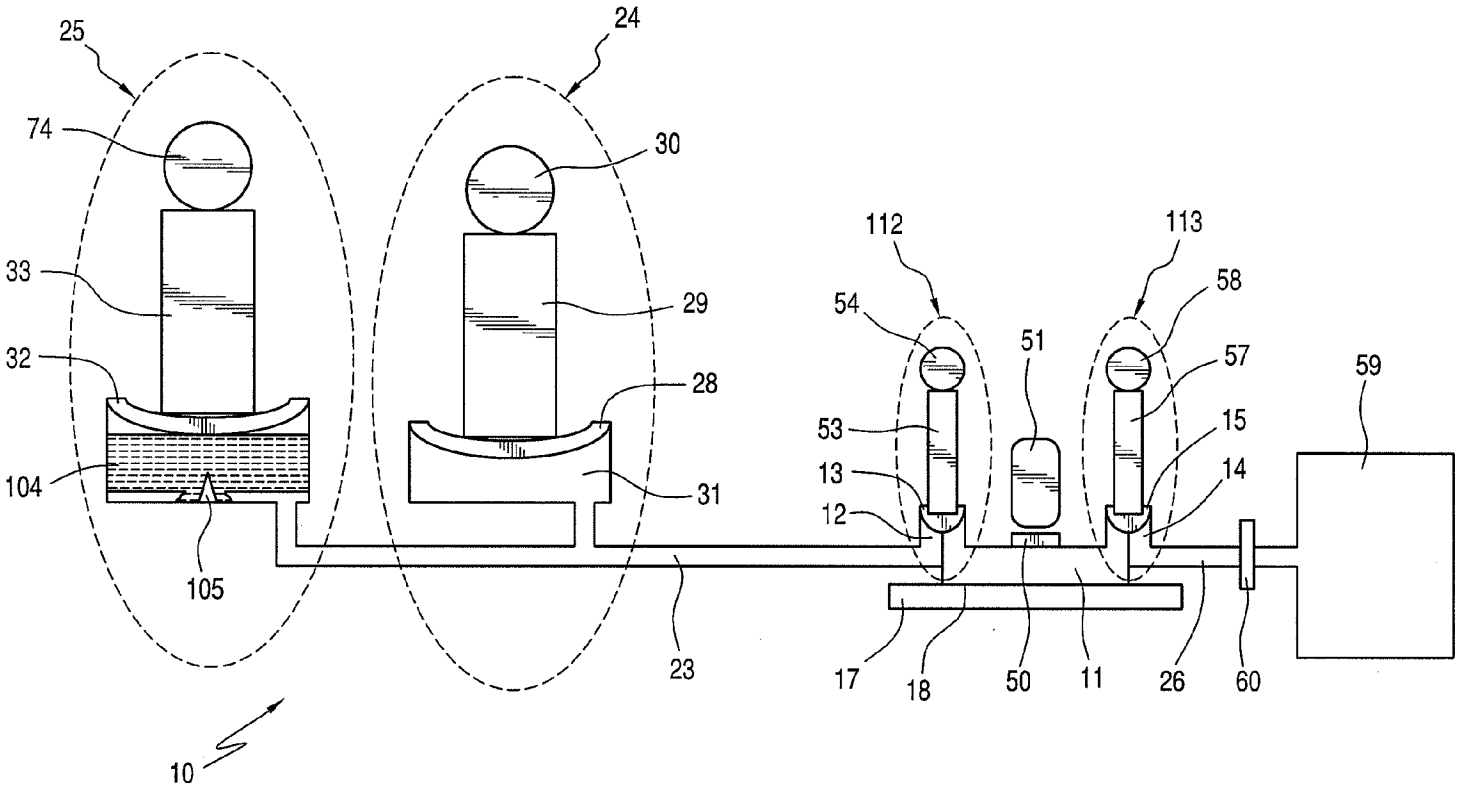

Regarding the pump 24, it is preferably formed as a flexible diaphragm 28 (see FIGS. 1, 3(*a*)-(*b*)) capable of engaging and being actuated by a plunger 29 on an instrument 30 (see FIGS. 1, 3(*a*)-(*b*), respectively) with which the device mates. In one exemplary embodiment, a void 31 (see FIGS. 3(*a*)-(*b*)) in a plastic housing is covered and sealed in an air-tight manner by a flexible latex sheet. While the pump is preferably actuated automatically by an instrument, it can also be actuated manually.

As illustrated in FIGS. 3(*a*)-(*b*), the fluid pouch 25 preferably contains a fluid 104 for performing nucleic acid amplification. The volume of fluid in the pouch 25 is preferably in the range of about 5 to about 100 uL. Like the pump 24, the pouch 25 includes a flexible diaphragm 32 capable of manual actuation or engaging and being actuated by a plunger 33 on an instrument 74 with which it is capable of mating. The pouch 25 is punctured by a barb 105 when the pouch with fluid 104 is forced against the barb 105. The fluid pouch 25 can contain a fluid for performing a nucleic acid amplification with one or more reagents including, deionized water, a buffer material, dNTPs, one or more primers and a polymerase. The polymerase can be in an inactive form bound to an antibody (e.g. anti-polymerase antibody) for stabilization, as is known in the art. After an initial heat cycle to denature the antibody, the enzyme becomes active. As will be apparent to those skilled in the art, the pouch 25 should be made of a material selected for biocompatibility of exposed surfaces, chemical/UV resistance, sterility, sealability, reliable fluid release and low wet retention, as well as other like factors. This is preferably by a form-fill-and-seal method using plastic coated metal foils of the following type, PRIMACOR™ (Dow Chemical Company, Midland, Mich.) coated aluminum foil. Alternatively other plastic-coated foils can be used. Such plastic-coated foils are widely commercially available.

As illustrated in FIGS. 7(*a*)-(*d*), while one wall 17 of the amplification chamber 11 is preferably silicon, other materials can also be used as described above. Such materials are selected to be thermally conductive materials and also support fabricated structures on the exterior surface, in addition to providing biocompatibility of exposed surfaces with amplification reagents and providing for sterility.

The other walls 34, 35 of the amplification chamber 11 are preferably made of plastic, such as, for example, polycarbonate (lexan), acetal (delrin), polyester, polypropylene, acrylics, and ABS and other like materials. While plastics are moldable to desired geometries, they generally have poor thermal conduction properties. Accordingly, the design of the plastic parts of the chamber wall substantially reduce the thermal mass in order to improve efficiency of operation, i.e., the thermocycling efficiency. An alternative is to use plastic materials that have been modified to improve their conductive properties. Such products are known in the art and are available from various companies including, for example, Cool Polymers Inc. (Warwick, R.I.), LNP (KONDUIT™) (offered by GE Plastics, Pittsfield, Mass.), and PolyOne Inc. (Avon Lake, Ohio). In one exemplary embodiment, the entire or substantially entire amplification chamber 11 can be made of a conductive polymer (e.g., COOLPOLY™ D-Series made by Cool Polymers Inc.), in one or more parts. According to such an exemplary embodiment, the heater and temperature sensor components can be screen printed onto the plastic surface, or formed as a flexible plastic circuit and bonded to the conductive plastic component. Circuitry made on flexible plastic sheets is well known in the art and made by companies including Flextronics Inc. (Singapore).

In a preferred exemplary embodiment, while the plastic portion of the wall of the amplification chamber 11 can have a thickness in the range of about 0.1 to about 5 mm, it is preferably about 0.25 to about 0.5 mm. Such a preferable thickness meets the minimum requirements of physical integrity and supporting sealing of the closed chamber at elevated temperature, e.g., near-boiling point in PCR amplification, and the associated increase in pressure. Preferably, one or more additional rib supports 36 are provided to confer improved rigidity to this component.

To provide leak-proof bonding between the silicon wall 17 and the plastic wall 35, a double sided adhesive tape gasket 37 of FIG. 1 and FIGS. 7(*a*)-(*b*) can be used. The double-sided adhesive tape gasket 37 is preferably selected to be biocompatible and adhere over a temperature range of about −60° C. to around 150° C. In other words, it should seal sufficiently well such that the material inside the chamber 11, during a PCR or other amplification reaction, is retained and does not leak out. This tape must also preferably have heat curing requirements within the range compatible with the plastic. Furthermore, the tape gasket 37 can include design features where it seals to the plastic, but preferably leaves a space that is in contact with the fluid, much like a washer or O-ring. A preferred adhesive tape material is 9244 tape supplied by 3M Corporation (St. Paul, Minn.), although other suitable adhesive tape materials can be used. For example, the 9244 tape accommodates adhesion between materials with different coefficients of expansion, e.g., silicon and plastic, and seals over the desired operating temperature range. It also withstands pressure changes and is biocompatible. This tape can also be pre-cut and placed on rolls for automated manufacturing. Alternatives to tape gasket materials include, for example, Dow Corning (Midland, Mich.) sealant 3145 RTV. A further alternative can be to glue the silicon to the plastic to form the seal, with suitable glues including, but not limited to, Hernon 126 (offered by Hernon Manufacturing, Sanford, Fla.), 3M bonding films and LOCTITE™ glues (offered by Henkel Corp., Rocky Hill, Conn.).

With regard to the proportion of the area of the amplification chamber wall 17 that is formed by silicon, it is preferably in the range of about 30 to about 50%. In a preferred exemplary embodiment, as illustrated in FIG. 2, it is about 31%. The objective is to maximize the heating and cooling surface area of the chamber wall 17, while keeping the chamber volume relatively low. In a preferred exemplary embodiment, the internal volume of the chamber 11 is in the range of about 5 uL to about 50 uL, preferably about 15 to about 25 uL. In the exemplary embodiment illustrated in FIG. 2, the silicon wall 17 has a chamber surface area of approximately 40 $mm^2$, with a depth of approximately 0.375 mm, giving a chamber volume of approximately 15 $mm^3$. The total chamber surface area is approximately 90 $mm^2$, i.e., approximately 40 $mm^2$ each for the top and bottom walls plus approximately 10 $mm^2$ for the side walls. Preferably, the amplification chamber surface area is in the range of about 50 to about 200 $mm^2$, and the volume is in the range of about 5 to about 30 $mm^3$. The sealable sample entry orifice 16 increases the amplification chamber volume by approximately 5 uL.

With respect to the shape of the amplification chamber 11, it is preferably substantially rectangular with a low height, as shown in FIGS. 3-7, but can also be rectangular with rounded corners and also edges. Other useful shapes include a cylindrical structure and a shape that is roughly oval in cross-section. The objective of the design is to provide for fluid mobility in and out of the amplification chamber 11 and also minimize bubbles being trapped in the chamber 11. It is advantageous to ensure that the chamber 11 is substantially free of bubbles, as during the heating cycle expansion of trapped bubbles can contribute significantly to an increase in pressure in the chamber 11. Such conditions result in a requirement for more robust sealing of the chamber features. Further, the trapped bubbles can impact the thermal status within the amplification chamber 11. While the device 10 is designed to withstand the additional pressure, it is desirable to avoid features that can trap or induce bubbles. Preferably, the chamber 11 and conduits 23, 26 of the device 10 include surfaces that are wettable and lack sharp angles and void spaces, as illustrated in FIG. 2. A preferred shape for the amplification chamber 11 is a rhomboid as illustrated in FIG. 2, although other suitable shapes can be used.

As illustrated in FIG. 7(*d*), the exterior surface 19 of the silicon wall 17 includes a heating circuit 20 that can comprise, for example, a resistive electrical path fabricated on that surface with a first and second connecting pad (38, 39) for contacting an external circuit for providing current flow through the path. The wall 17 also includes a temperature sensor 21, e.g., a thermistor, thermocouple or RTD or the like, fabricated adjacent to the heating circuit 20. There are first and second connecting pads (40, 41) for contacting an external circuit for connecting to the sensor.

It will be apparent to skilled artisans that there are several ways for getting a nucleic acid sample into the amplification chamber 11. In a preferred exemplary embodiment (FIGS. 5(*a*) and 5(*b*)), the sample entry orifice 16 is capable of mating with a sample introduction device 42 that comprises a wand 43 with a first end with an absorbent pad 44 for collecting and retaining a nucleic acid sample and a second end 45 which acts as a convenient handle. The first end is designed to pass through the sample entry orifice 16. In another exemplary embodiment (FIGS. 6(*a*) and 6(*b*)), the wand 43 also has a locking feature 46 between the first and second end for engaging and sealing the wand in the sample entry orifice. A gasket 101 provides an effective seal at the sample entry orifice 16. After inserting the wand 43 into the sample entry orifice 16, a locking mechanism 102 is pushed in place to secure wand 43 and to affect a seal with gasket 101.

Figure 5A:
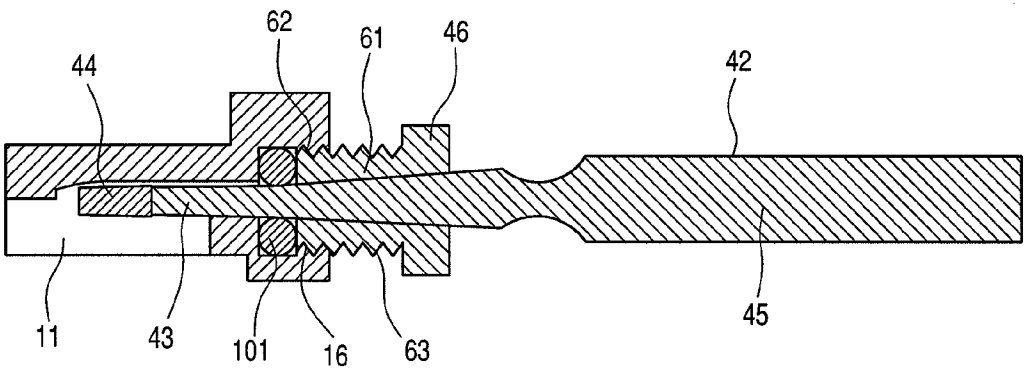
FIGS. 5 (*a*)-(*b*) illustrates the DNA swab device for collection of a buccal swab sample mating with a single-use DNA amplification device by a screw-in means, in accordance with an exemplary embodiment of the present invention.
Figure 5B:
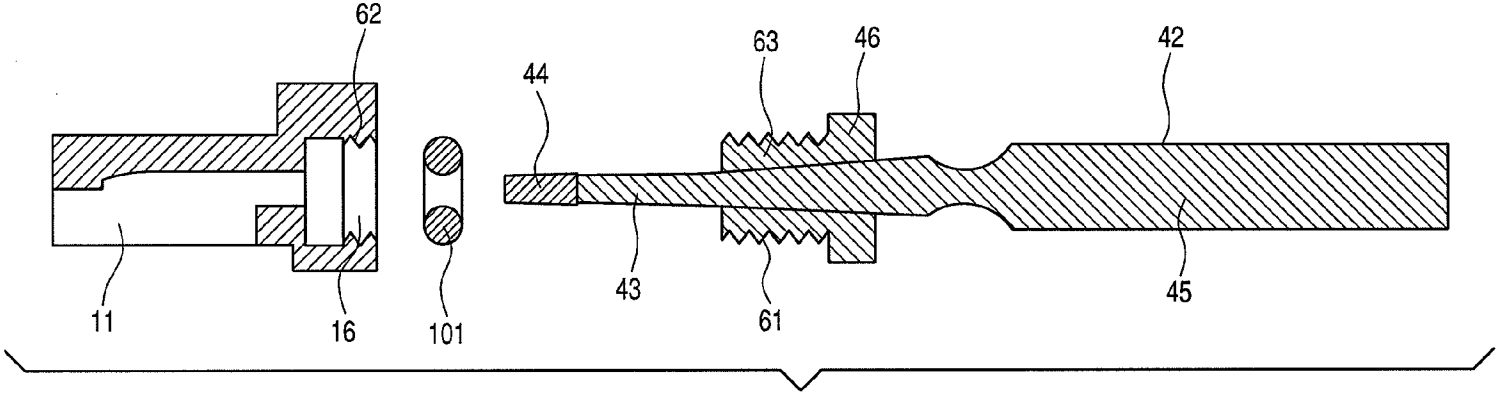
Figure 6A:
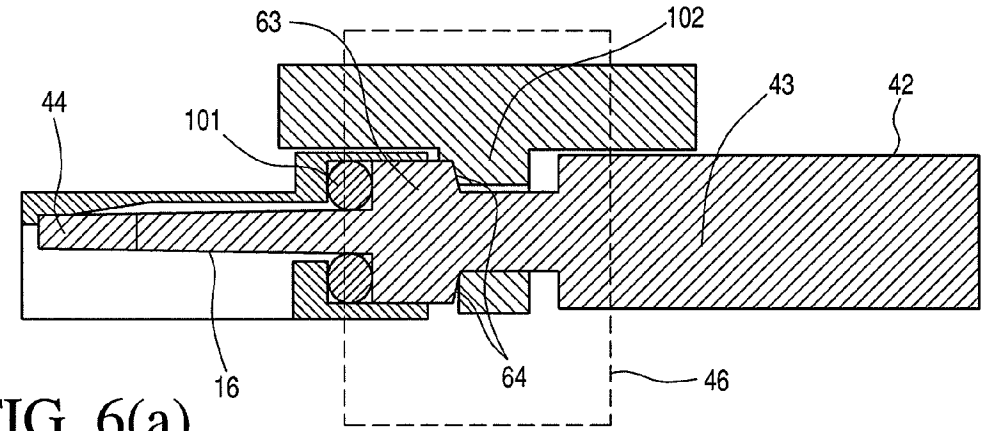
FIGS. 6 (*a*)-(*b*) illustrates the DNA swab for collection of a buccal swab sample mating with a single-use DNA amplification device by a latch means, in accordance with an exemplary embodiment of the present invention.
Figure 6B:
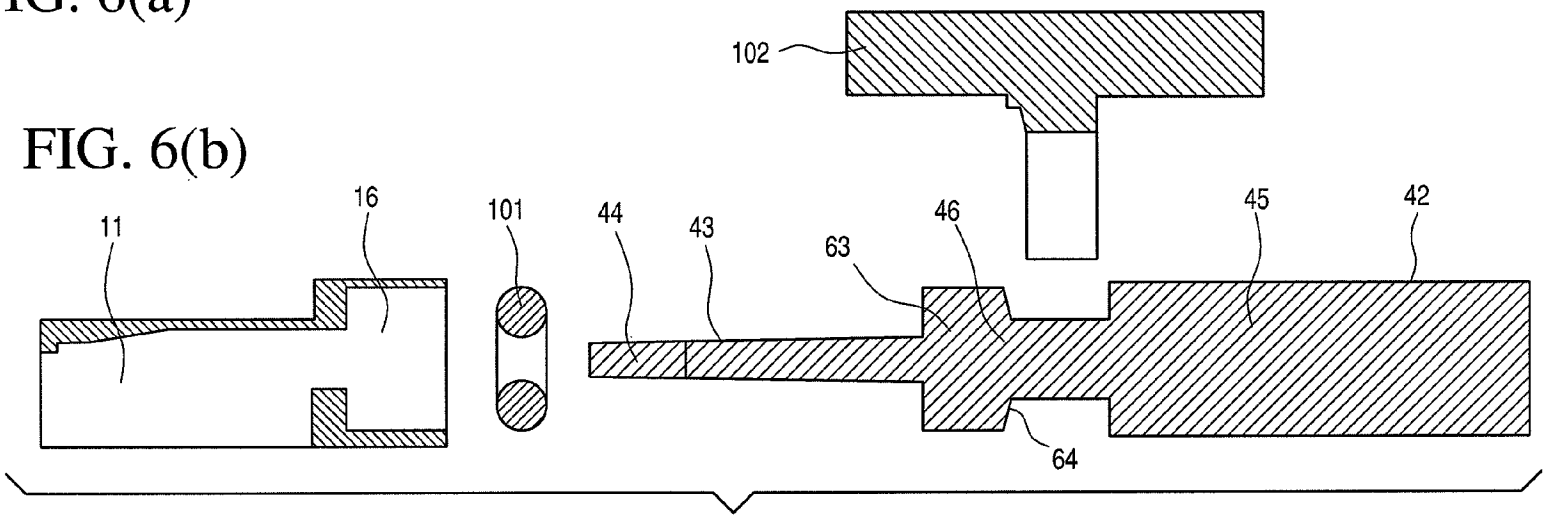
Figure 7A:
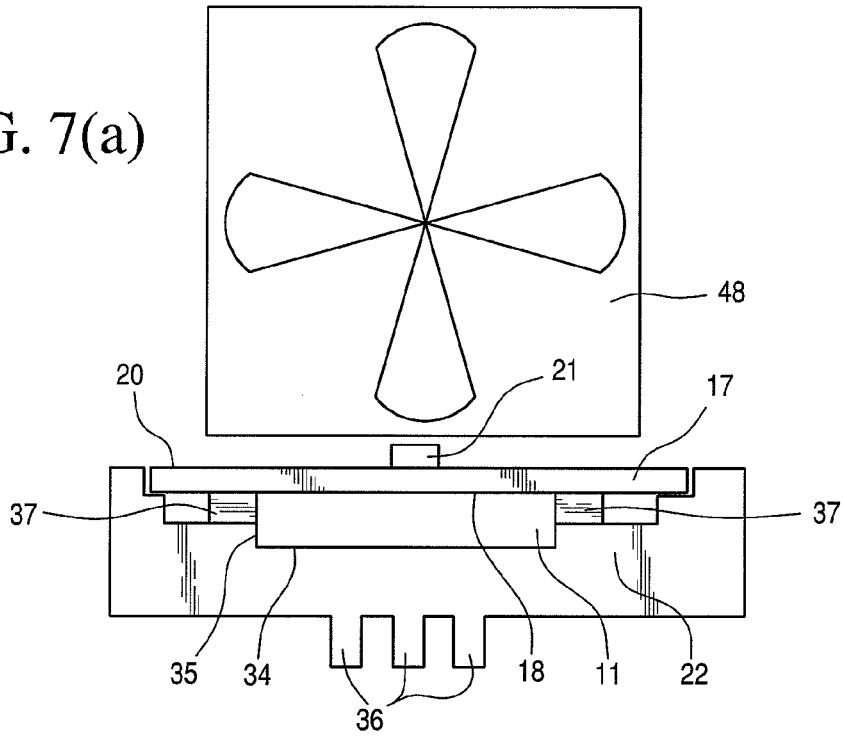
FIGS. 7 (*a*)-(*d*) illustrates the silicon chip forming a wall of the amplification chamber where the exterior surface has a heating circuit and a temperature sensing circuit, in accordance with an exemplary embodiment of the present invention.
Figure 7B:
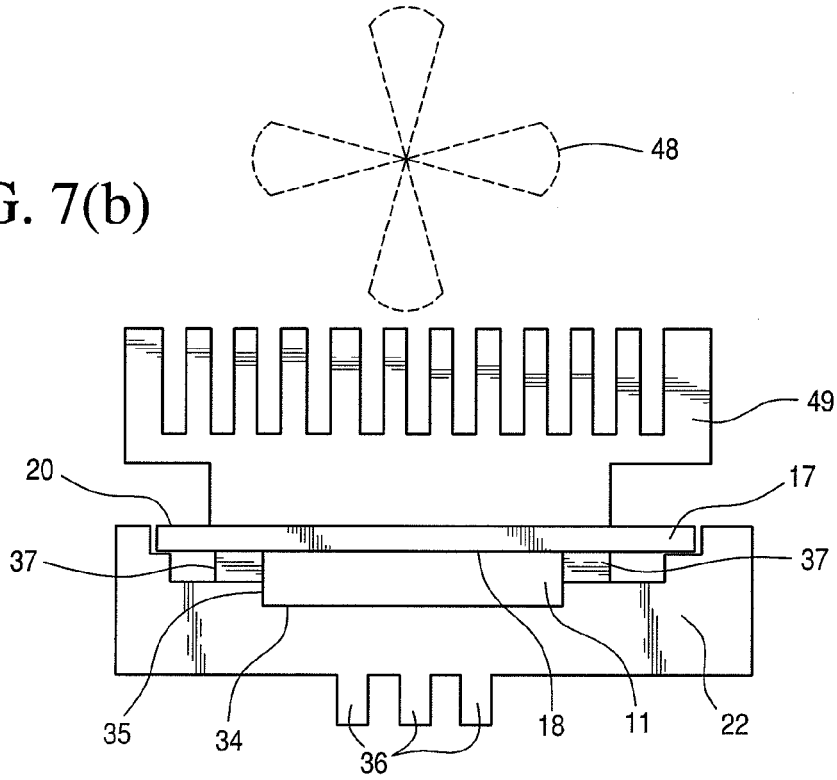
Figure 7C:
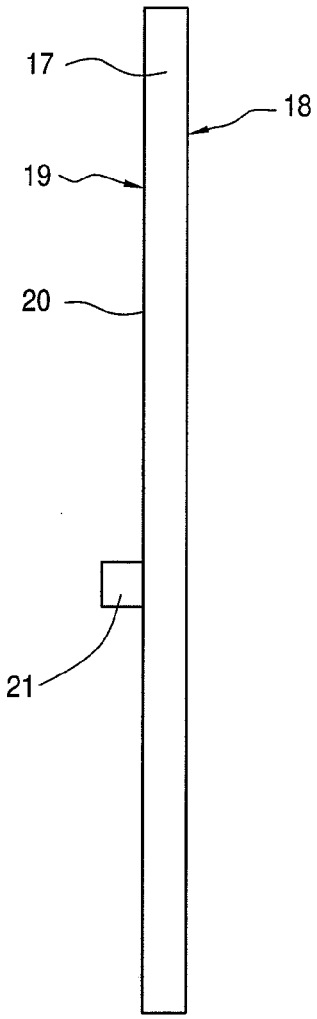
Figure 7D:
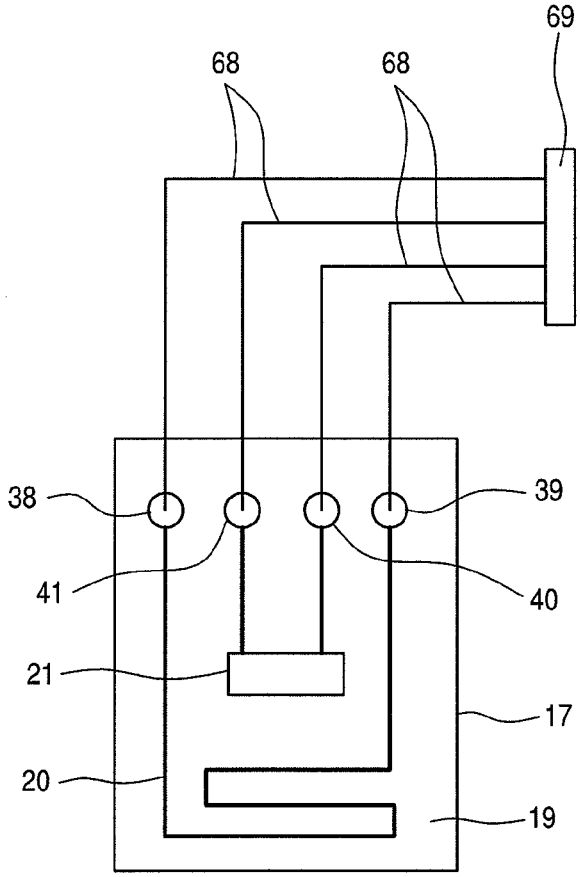

In one exemplary embodiment for the sample entry orifice 16 illustrated in FIGS. 5(*a*) and 5(*b*), the engaging and sealing features are a male screw feature 61 on the wand and a female screw feature 62 on the sample entry orifice 16. In another exemplary embodiment illustrated in FIGS. 6(*a*) and 6(*b*), the engaging and sealing features are a male collar 63 locking feature on the wand and a female collar 64 locking feature on the sample entry orifice.

Regarding the sample type, the absorbent pad 44 can be used for a cheek swab to introduce buccal cells directly into the amplification chamber 11. It has been found that heat cycling of these cells is sufficient to liberate the nucleic acid for amplification. As a result, a buccal swab sample can be introduced and amplified without further sample preparation. The absorbent pad 44 can also be used to transfer nucleic acid from another separation process or device. For example, a DNA binding material can be affixed to the end 44 of the sample introduction device 42, wherein the sample is treated in a manner to come in contact with the swab end material, which is subsequently washed of inhibitory substances. The sample introduction device 42 is then inserted into the amplification device 10 through orifice 16. The materials that can be tested could be chosen from the list of blood, urine, tissue, bone, hair, environmental sample, soil, water, and other like materials. As is apparent to those skilled in the art, many sample preparation devices and reagents are available commercially.

As will also be apparent to those skilled in the art, the device 10 uses reagents for performing amplification, including a polymerase, dNTPs, one or more primers and a buffer. These can be added externally through the sample orifice 16, or, more preferably, be present in the device 10 before use, such as being incorporated as part of the device assembly process. The reagents can be located individually or together in the amplification chamber 11, in the conduit 23 attached to the ingress 12 or in the fluid pouch 25. In a preferred exemplary embodiment, the amplification chamber 11 can include a sugar glass coating, i.e., dehydrated and glassified reagents, on at least a portion of the interior surface 18 of the silicon wall 17. The sugar glass coating can include reagents and a buffer, dNTPs (e.g., four natural deoxynucleotidyl triphosphates dATP, dCTP, dGTP and dTTP can be used, however it is well known in the art that modified deoxynucleotidyl triphosphates can also be used), one or more primers and a polymerase (*Thermus aquaticus, Thermococcus* spp., and others well known in the art). Suitable sugars, either individually or in combination, can be chosen from the following: sorbitol, trehalose; arabinose; ribose; xylose; xylitol; fructose; galactose; glucose; mannose; rhamnose; sorbose; glucitol; maltose; mellibose; sucrose; maltitol; hydrocolloids; or other sugar containing polymers including cellulose, DEAE-dextran, dextran, locust bean gum, guar gum, agar and carboxymethylcellulose.

The present device 10 enables the amplification chamber 11 to achieve a temperature increase ramp rate in the range of about 10 to about 50° C. per second, preferably about 15 to about 30° C. per second, and a temperature decrease ramp rate in the range of about 4 to about 20° C. per second, preferably about 6 to about 8° C. per second.

The method of cooling is preferably implemented where the device engages and is operated by an instrument. The instrument includes a fan 48 (see FIGS. 7(*a*)-(*b*)) for cooling the amplification chamber 11. The fan 48 is optimally positioned close to the surface of the silicon wall 17 to provide the desired angle of the air stream, as shown in FIG. 7(*a*). The fan 48 is activated to coincide with the desired heating and cooling cycle. Additionally or alternatively, the instrument has a heat-sink 49 capable of reversibly contacting and cooling the amplification chamber 11, as illustrated in FIG. 7(*b*). In a further exemplary embodiment, the silicon wall 17 includes a Peltier circuit on the exterior surface 19 adjacent to the heating circuit 20.

In certain exemplary embodiments where it is desirable to perform real-time PCR, the amplification chamber 11 includes an optical window 50, as illustrated in FIGS. 2, 3(*a*), 3(*b*), 4(*a*), and 4(*c*). The window 50 enables fluorescence detection of a signaling reagent within the chamber 11 to be measured by an optical detection component 51 (see, e.g., FIGS. 3(*a*) and 3(*b*)) in the instrument. It will be understood by those skilled in the art that the optical detection component 51 described herein can be composed of a means of generating fluorescence at one wavelength and can be composed of a filter to prevent certain wavelengths. Furthermore, the optical detection component 51 can have the means to detect an increase in fluorescence at a second wavelength. Alignment features on the cartridge and instrument enable proper mating of the two to ensure reliable measurement. Optical detection methods for real-time PCR are well known in the art.

Referring to FIG. 2, the reversible seal 13 or valve on the ingress 12 is preferably a flexible diaphragm that is actuated into a closed position by an applied force and is in an open position in the absence of the applied force. As illustrated in FIGS. 3(*a*) and 3(*b*), the force is preferably provided by a pin 53 in the instrument that is controlled by a motor 54. The dimensions of the conduit 23 at the ingress 12 are preferably about 0.03125" wide and 0.25" long (although the dimensions can be of any suitable width and length), and the area of the diaphragm can be 0.187 square inches (although the diaphragm can have any appropriate area). The force applied to make the seal can be in the range of about 0.25 lbs to about 5 lbs, although any suitable amount of force can be used to make the seal. Materials suitable for the diaphragm include, but are not limited to, natural rubber, latex, silicon rubber, over-molded flexible plastics (GE Plastics, GLP-division, Pittsfield, Mass.), and the like.

Figure 4A:
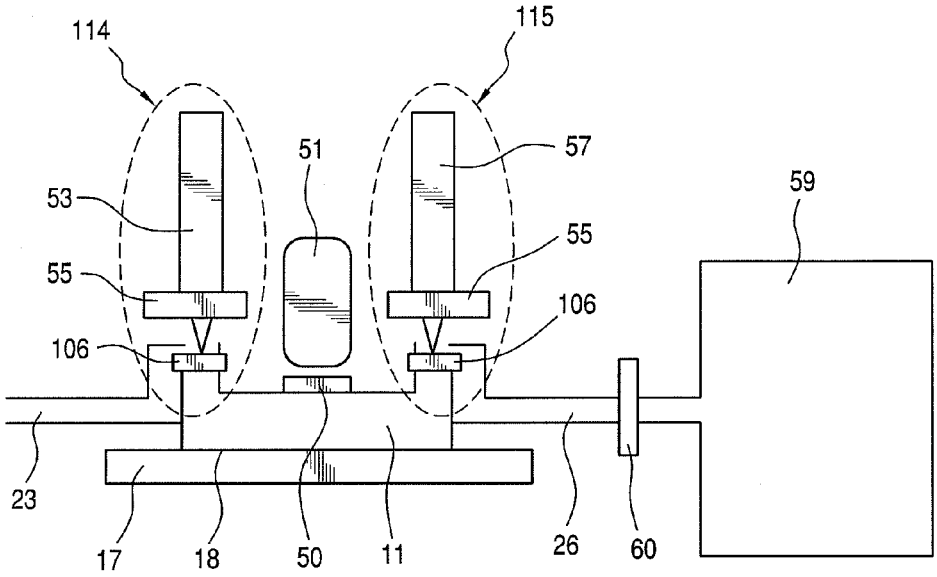
FIGS. 4 (*a*)-(*b*) illustrate the ingress and egress valves with flexible diaphragm seals and with pylon seals, respectively, in accordance with an exemplary embodiment of the present invention.
Figure 4B:
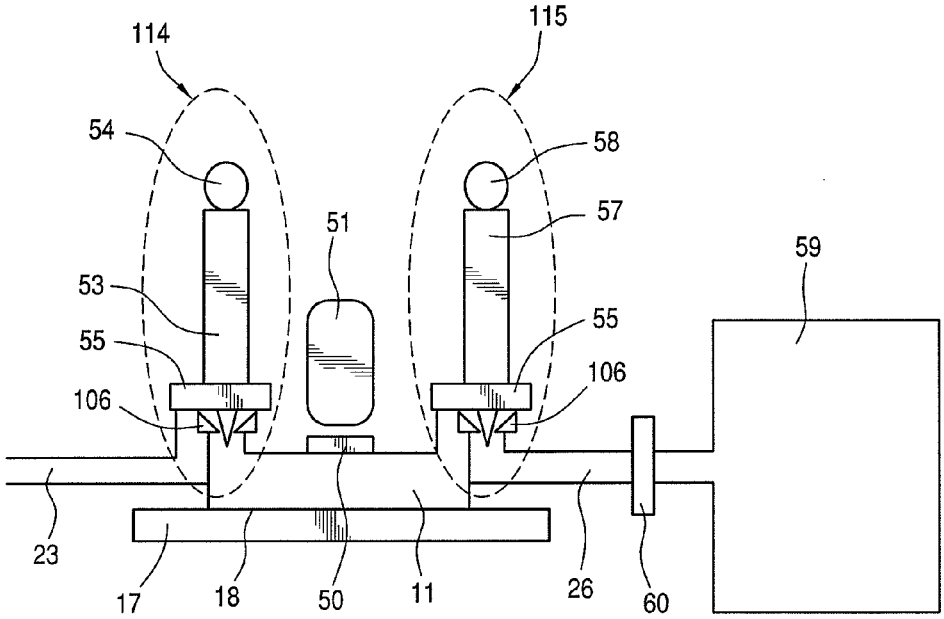

An alternative valve design can be based on a pylon-type structure is illustrated in FIGS. 4(*a*)-(*b*). Fluids required for the amplification reaction can be sealed into the amplification chamber 11 and sealed at the ingress 12 and egress 14 with tape or foils as depicted by 106. The sample entry port 16 can also sealed by tape or foil. The seal is punctured when the wand 42 is pushed into the amplification chamber 11, with the fluid remaining inside the chamber 11. The amplification reaction is then allowed to proceed. After the amplification cycle, seals 106 are punctured by the barbs on the pylon-type structure 55, affected by pins 53 and 57. Air pressure generated in the previously described air bladder can be used to move fluid into the detection chamber 59, also referred to herein as a detection device and detection cartridge. Mechanical connector 114 (e.g., a pylon-type sealing mechanism or the like) can be used to control the ingress valving feature. Mechanical connector 115 (e.g., a pylon-type sealing mechanism or the like) can be used to control the egress valving feature.

Referring to FIG. 2, the reversible seal 15 or valve on the egress 14 is preferably a flexible diaphragm that is actuated into a closed position by an applied force and is in an open position in the absence of the applied force. As illustrated in FIGS. 3(*a*)-(*b*), the force is preferably provided by a pin 57 in the instrument that is controlled by a motor 58. The other general features of the egress reversible seal 15 are similar to those of the ingress reversible seal 13. Preferably, the ingress 12 and egress 14 are in opposite corners or on opposite sides of the amplification chamber 11.

Detection of the amplicon can either be by in situ detection through the window 50 in the amplification chamber 11, e.g., real-time PCR, or, more preferably, in a second custom detection device 59. Here, the second conduit 26 attached to the egress valve permits egress of the amplicon. In one exemplary embodiment, a mating feature 60 (see, e.g., FIGS. 2, 3(*a*), 3(*b*), 4(*a*), and 3(*b*)) at the end of the second conduit 26 enables engagement of the amplification device 10 with the detection device 59 for leak-proof transfer of the amplicon. In other exemplary embodiments, the amplification device 10 and the detection device 59 are directly connected, with fluids transferring via the channel provided by the second conduit 26.

As illustrated in FIG. 2, in another exemplary embodiment, the conduit 23 connected to the ingress 12 can include a first fluid detection system 116. The first fluid detection system 116 can include a chip insert 65, preferably made of silicon, with a fluid detection sensor 66. At the ingress 12, the portion of the chip 65 is optionally coated with one or more nucleic acid amplification reagents. The fluid detection sensor 66 is used to detect that fluid has entered the amplification chamber 11. When no conductivity is detected, all (or substantially all) of the fluid has been moved into the amplification chamber 11. Similarly, a second fluid detection system 117 comprising an upstream sensor 65 (e.g., located in the conduit 26 connected to the egress 14) is used to detect that all (or substantially all) of the fluid has been removed from amplification chamber 11 after the amplification cycle.

As illustrated in FIG. 1, the instrument 111 includes a recess 67 for receiving and engaging the device 10, and also includes an electrical connector 68 for contacting the heating circuit and electrical connector 69 for contacting the temperature sensor circuits. The instrument 111 also includes mechanical connectors 25, 24, 112 and 113 that independently interact with the device 10. Mechanical connector 25 can be used to introduce fluid into the amplification chamber 11. Mechanical connector 24 can be used with an air bladder to control fluid movement in the device 10. Mechanical connector 112 can be used to control the ingress valving feature. Mechanical connector 113 can be used to control the egress valving feature.

Figure 8:
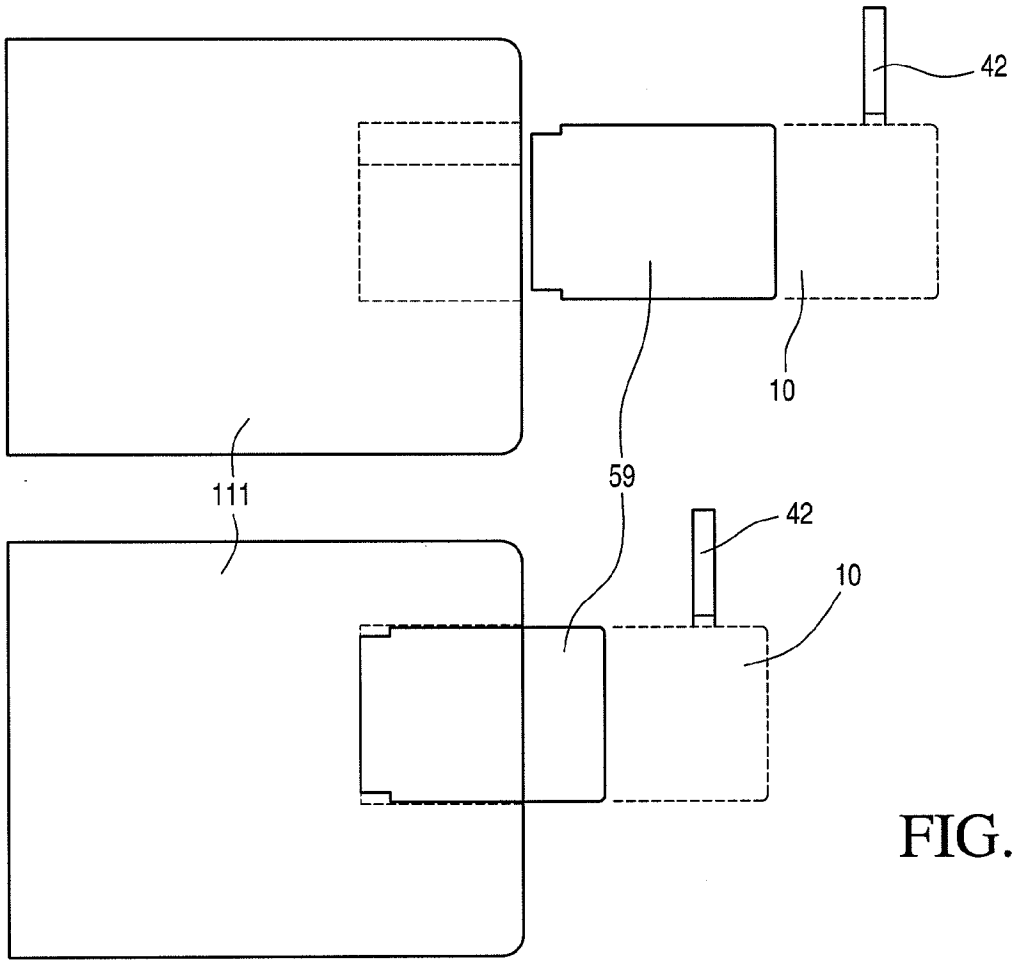
FIG. 8 illustrates the integrated single-use DNA amplification device interaction with an instrument, in accordance with an exemplary embodiment of the present invention.

Mechanical connectors 25, 24, 112, and 113 have similar features. Each of the mechanical connectors 25, 24, 112, and 113 has a motor system 74, 30, 54 and 58, respectively. In addition, each of the connectors also has a pin feature 33, 29, 53 and 57, respectively. As illustrated in FIG. 8, the detection device 59 connected to the amplification device 10 with attached wand 42 is inserted into instrument 111.

Assembly of the preferred exemplary embodiment reflects the need to provide a simple and reliable manufacturing method for achieving large annualized production of amplification devices, e.g., in the many millions. An assembly process for a preferred embodiment can be as follows: an injection molded plastic component with fluid paths is used as a base element into which a fluid pouch and silicon chips are added. Double sided adhesive tape is applied to the base holding the chips and pouch in place, then a second plastic cover component is applied to the tape and sealed. These types of processes are amenable to automated manufacture.

Figure 12:
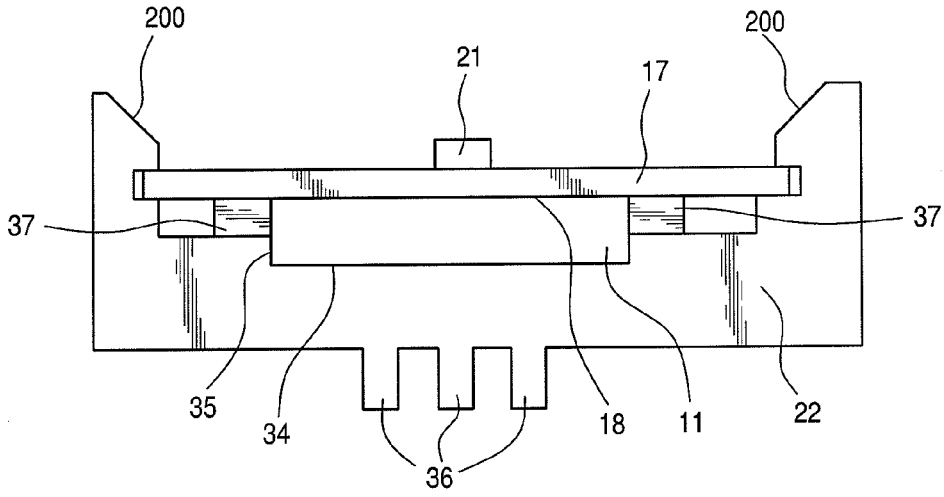
FIG. 12 illustrates the cross section of a single-use DNA amplification device with respect to the clipping means of attaching the silicon heater to the amplification chamber, in accordance with an exemplary embodiment of the present invention.
Figure 13:
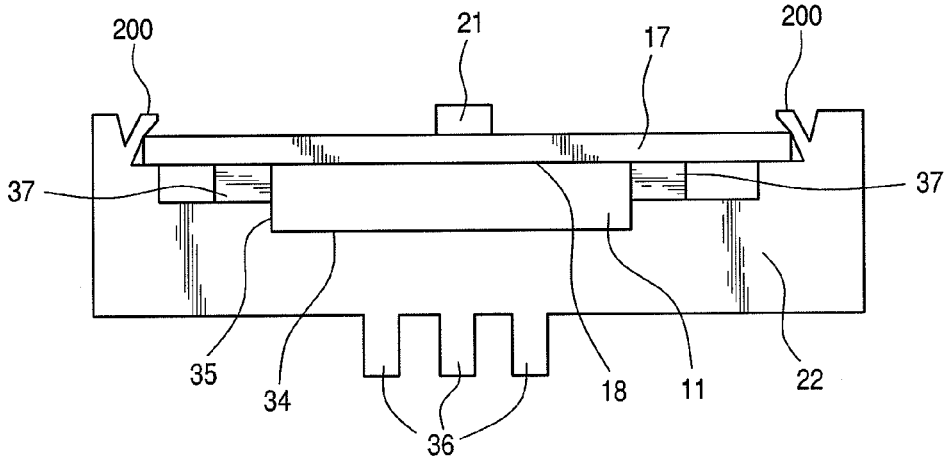
FIG. 13 illustrates the cross section of a single-use DNA amplification device with respect to a staking means of attachment, in accordance with an exemplary embodiment of the present invention.

In one specific additional exemplary embodiment illustrated in FIG. 12, the wall 17 can be held firmly in contact with the plastic component 22 and tape 37 by one or more holding means 200, such as, for example, a snap-closure feature or the like that enables the chip to be engaged but not retracted. Such a structure has the added advantage of providing further assurance that the chamber 11 does not leak during thermocycling. Various suitable configurations of the holding means 200 can be used to firmly hold the wall 17 in contact with the plastic component 22 and tape 37. For example, an alternative structure for the holding means 200 is illustrated in FIG. 13.

In the present invention, where electrochemical detection is preferred, the main objective of the nucleic acid amplification step is to generate about a 0.01 picomolar concentration of detectable nucleic acid from the target molecule. It has been found that this is in the range of the lower detection limit of a sandwich assay with enzymatic amplification and electrochemical detection. The desired one picomolar concentration of fragment is based on Avogadro's number (1 mole=$6\times10^{23}$ molecules), where 1 pmol equals $6\times10^{23}\times10^{-12}$, or about $10^{12}$ molecules. If, as is known, one microliter of blood contains about $5\times10^{3}$ molecules of DNA, then one milliliter, which is a reasonably accessible sample volume, contains approximately $5\times10^{6}$ molecules, or roughly about $10^{7}$ molecules. To go from the amount of DNA in 1 ml of blood to 0.01 pmol of DNA requires an amplification of about $10^{3}$ fold. Such an amplification is certainly achievable using several well known amplification techniques. Performing a similar calculation, for a different sample types and sample volumes, to determine the degree of amplification will be apparent to those skilled in the art.

The polymerase chain reaction (PCR) is well known for its ability to specifically amplify regions of target DNA based on the primer sequences chosen for the PCR reaction. In a preferred exemplary embodiment, a novel method of performing a PCR reaction is used that combines DNA polymerase, a target nucleic acid, and amounts of two modified primers, where the first modified primer has a sequence of bases to a region of the target. A polymerase blocking region is attached to this primer that is linked to a single stranded hybridization region. The second modified primer has a sequence of bases to a second region of the target and also a polymerase blocking region and a second single stranded hybridization region. A detectable moiety (e.g., biotin, fluorocein, or the like) is attached to one or both of the two modified primers. To run the PCR reaction, the mixture is cycled to generate multiple copies of an amplicon incorporating the modified primers. Advantageous to such a method, excess unincorporated modified primers, with the detectable moiety, are substantially eliminated from the final amplicon product. In a preferred method, the primers form a self-annealing hairpin structure that prevents them from interfering in the detection step. In a preferred method, the amplicon product is transferred from the amplification chamber 11 to the detection device 59, as described above. In the detection device 59, the amplicon product contacts a capture oligonucleotide that is complimentary to one or both of the single stranded hybridization regions to permit hybridization with the amplicon. In the last step, the moiety associated with this hybridization is detected directly, for example by fluorescent detection of fluorocein. Alternatively, the moiety, e.g., biotin or the like, is exposed to and binds with a streptavidin-labeled enzyme, e.g., alkaline phosphatase or the like, and the enzyme activity is determined either optically or electrochemically.

Figure 14:
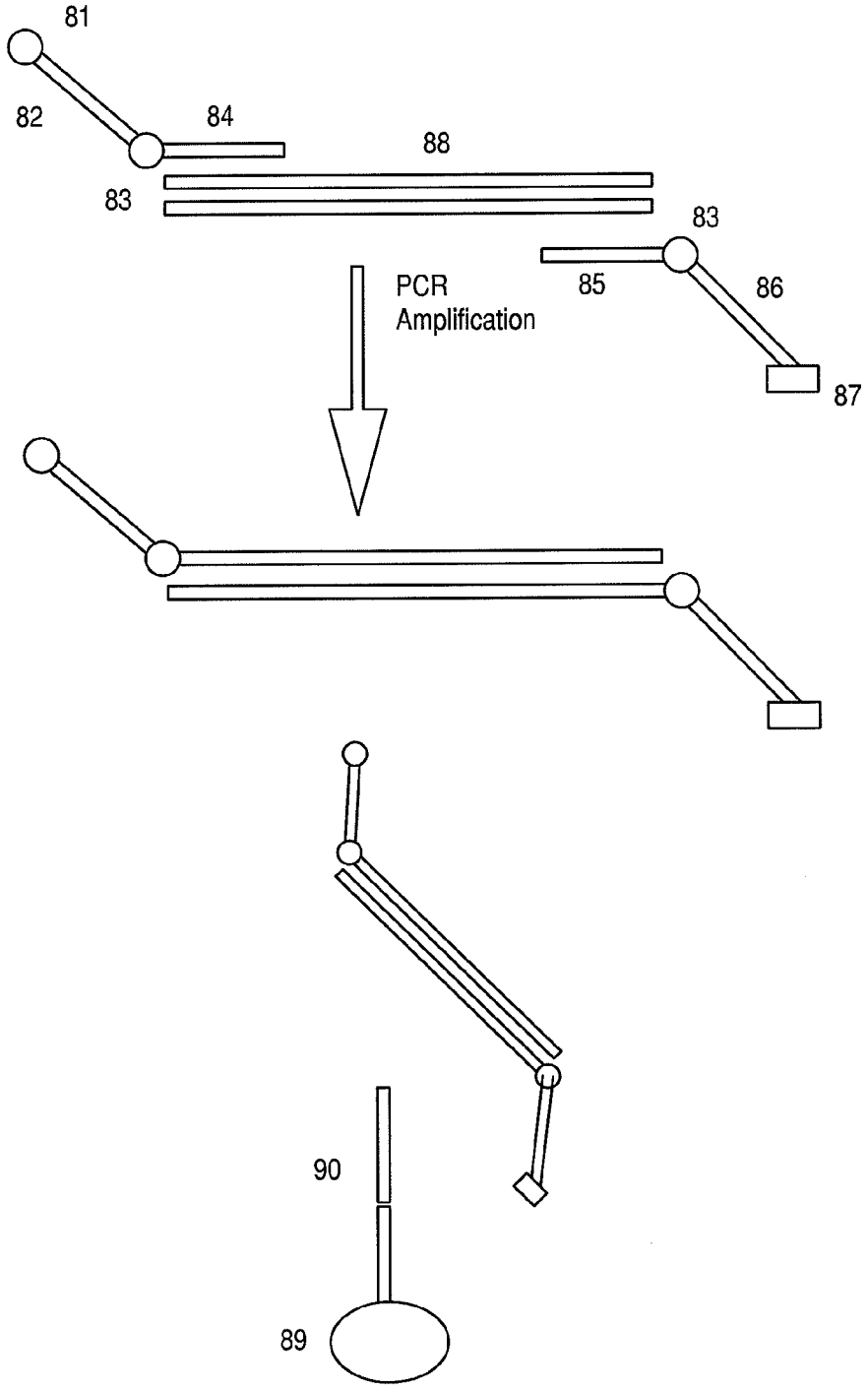
FIG. 14 illustrates a preferred reaction sequence for PCR amplification, in accordance with an exemplary embodiment of the present invention.

The reaction sequence is illustrated in FIG. 14, where 81 is the detection moiety, e.g., biotin, FAM, DNP, cholesterol, fluorocein, or the like, 82 is the first single stranded hybridization region, 83 is the polymerase blocking region, e.g., hexaPEG or the like, 84 is the first PCR primer, 85 is the second PCR primer, 86 is the second single stranded hybridization region, 87 is a second detectable moiety, 88 is the double stranded nucleic acid target sequence, 89 is a solid substrate, e.g. bead or surface, and 90 is a hybridization region complementary to 86.

For a preferred exemplary embodiment, the first and second PCR primers 84 and 85 are preferably synthesized using standard phosphoramidite chemistry, and can include any nucleotide or modified base that is amenable to DNA polymerase, except in the polymerase blocking region 83. An example of a polymerase blocking region sequence can include the spacer phosphoramidite 18-O-dimethoxyltritylhexaethyleneglycol,1-[(2-cyanoethyl)-(N,N-diisopropyl)]-phosphoramidite. Such a phosphoramidite generates a hexaethyleneglycol spacer region. Other suitable spacer molecules with similar properties can also be used for this purpose. Alternatives to phosphoramidite chemistry can be used, including, but not limited to, creating a 3'-3' or 5'-5' phosphodiester backbone, as well as modified nucleotides as described by Newton, et al. (Nucleic Acids Research 21, pages 1155-62, 1993), and also described in U.S. Pat. No. 5,525,494. The PCR primer also preferably includes a terminal phosphorothioate bond, preventing the exonuclease activity of *T. kodakiensis* KOD1 DNA polymerase from not discriminating allelelic differences in primers used in SNP analysis based on the terminal base being different.

Allowing PCR to proceed using these synthetic oligonucleotide primers in the presence of the appropriate target and DNA polymerase with associated components generates a newly synthesized DNA molecule with incorporated single stranded regions 82 and 86. It has been found that while the Taq DNA polymerase can be used, a preferred embodiment uses *T. kodakiensis* DNA polymerase that exhibits a significantly higher turnover number. Such a molecule can then be hybridized by means of 86 to a target sequence 90 on a solid support 89. The binding moiety region can then be used for generating a signal, for example, by using biotin as the binding moiety and using streptavidin conjugated to a detection enzyme, e.g., horseradish peroxidase (HRP) or alkaline phosphatase (ALP) or the like.

Figure 9:
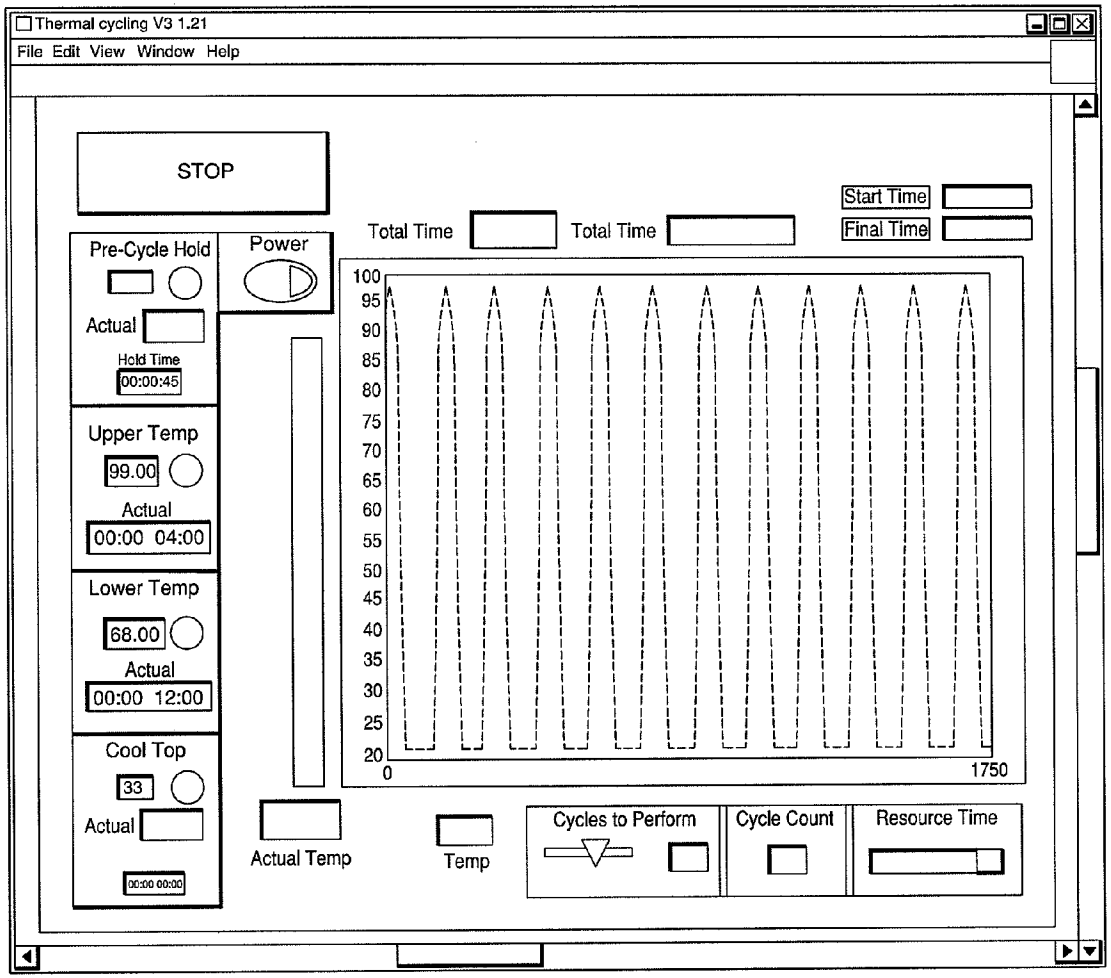
FIG. 9 illustrates a heating cycle profile versus time applied to the amplification device and the temperature response of the temperature sensor, in accordance with an exemplary embodiment of the present invention.
Figure 10:
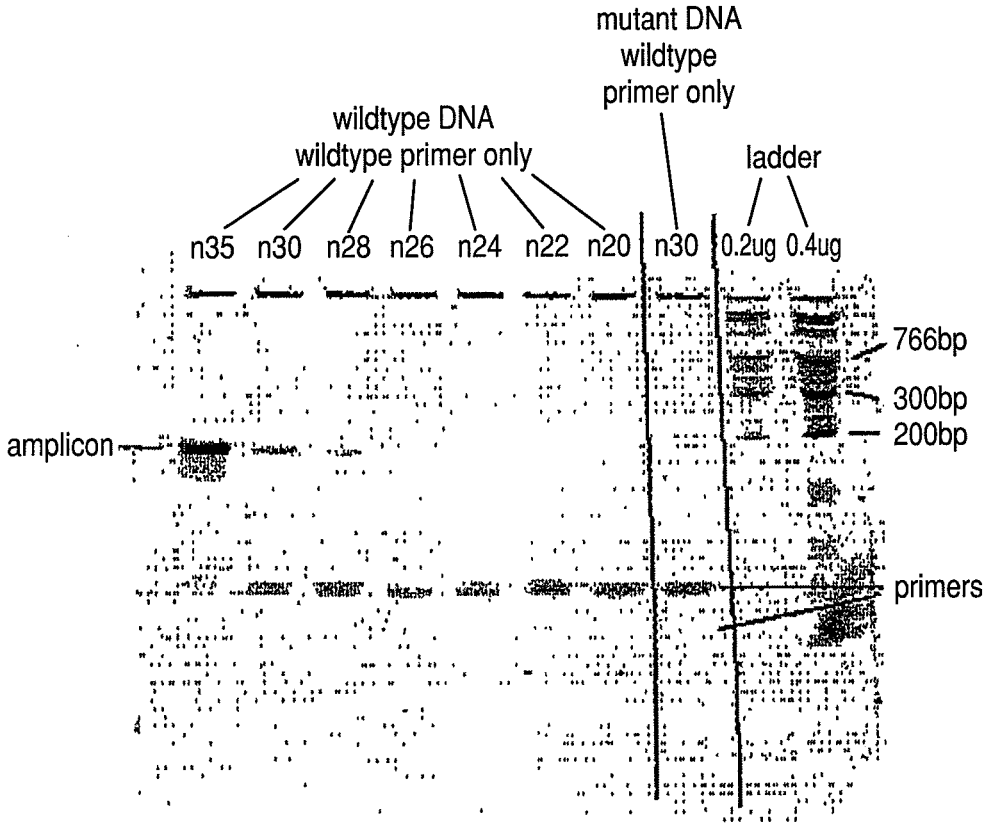
FIG. 10 illustrates gel electrophoresis of amplicons for target gene 1 (in example 1) after 22, 24, 26, 28, 30 and 35 PCR amplification cycles in the amplification device, in accordance with an exemplary embodiment of the present invention.

In a preferred exemplary embodiment, the nucleic acid amplification device is operated as follows: a sample of nucleic acid is collected into the absorbent pad on the wand and introduced into the amplification chamber 11 through the sample entry orifice 16. It is then screwed into position to seal the orifice. The cartridge is then inserted into the instrument 111 where it engages the electrical and mechanical connection features. In the first step, the instrument applies a force to the fluid pouch 25 causing the fluid to pass out of the pouch 25 and into the amplification chamber 11, where it is retained by the instrument applying a force to the ingress and egress seals 13 and 15. The fluid in the chamber 11 causes dissolution of the sugar glass coating of reagents on the silicon wall 17 to form a mixture of sample, buffer, polymerase and primers. Once the electrical connector has engaged the temperature sensor 21 and heating circuit 20, the cycling of the temperature in the chamber 11 is initiated. The cycling is between a first and second temperature for a predetermined time and for a predetermined number of cycles, as illustrated in FIG. 9. The fan 48 in the instrument adjacent to the silicon wall 17 of the device provides for the cooling part of the cycle. Once the amplicon is formed in sufficient amount for detection, the instrument releases the force applied to the seals 13 and 15 and opens the ingress 12 and egress 14 to the chamber 11. The mechanical connector of the instrument then applies a pneumatic force to the pump 24 attached to the ingress 12 and moves the amplicon from the chamber 11 through the egress 14 and into a detection cartridge 59.

The detection cartridge 59 can be operated as follows: about 20 μL of amplicon from the amplification chamber 11 is transferred, as described by the transfer method above, for detection by the enzyme-linked DNA hybrid sensor cartridge. The latter is described in jointly-owned U.S. Application Publication No. 2003/0170881. The detection device 59 is placed into an i-STAT model 300 electrochemical analyzer (i-STAT Corporation, East Windsor, N.J.) or other like instrument or analyzer. The sensor cartridge can include multiple (e.g., 2 or 4 or any suitable number) amperometric sensors coated with specific DNA oligomers (oligonucleotides). For purposes of illustration and not limitation, the oligonucleotides can be 5'-biotinylated oligonucleotides with 3' amine derivatives, and they can have at both termini a phosphorothioate backbone. These oligonucleotides are chemically bound to carboxyl derived beads at their 3'-amine derivatives by covalently bonding onto the sensor surface using the EDAC reaction, as is well known by skilled artisans. One of the sensors is bound with the complementary single-stranded DNA oligomer to one of the single-stranded portions of the PCR primers, as a control. Also present within this cartridge can be a separate streptavidin-alkaline phosphatase conjugate (strep-ALP).

In a preferred exemplary embodiment, the PCR amplified product and strep-ALP conjugate dissolved into a single solution can be brought into contact with the DNA capture sensors. Alternatively, it should be noted that the PCR product can be contacted with the sensor first, followed by the conjugate. In a preferred exemplary embodiment, the double-stranded PCR products, including both single-stranded hybridization regions, bind to the capture region on the amperometric sensor. Binding of the alkaline phosphatase label can occur either in solution before capture of the PCR product or after it has bound to the bead. After a controlled period of time, such as from about 5 to about 15 minutes, and at a controlled temperature (e.g., preferably about 37° C.), the solution is moved out of the sensor region and delivered to a waste chamber within the detection cartridge 59. A wash solution, containing substrate for ALP, is brought over the sensor washing excess strep-ALP conjugate away from the sensor region. A trailing portion of the wash solution remains on the sensor and provides an electrogenic substrate for the ALP label. Note that in an alternative exemplary embodiment, a wash solution can be used first, followed by a second solution containing the substrate. Note also that where an optical sensor or other type of sensor is used, other appropriate substrates can be used. In a preferred exemplary embodiment, the measured current at the capture sensor is essentially directly proportional to the number of ALP labels present on the sensor. An adjacent amperometric sensor that is not coated with the complementary DNA binding sequence can be used as a control sensor to offset any non-specific binding of the ALP reagent on the sensors, thus improving the detection limit. Alternatively or additionally, a capture oligonucleotide with a sequence different from the complimentary DNA binding sequence can be used as a negative control.

For purposes of illustration and not limitation, the following examples provide information on the amplification and detection of specific genetic markers.

Example 1

PCR Amplification of Hemachromatosis (Hfe) C282Y allele and detection

| Oligo designation | Sequence (5'->3') | Characteristics |
|---|---|---|
| Is083 | /5Bio/C*CAGA/iBiodT/CACAATGA GGGGCTGATC*C/ (SEQ ID NO: 1) | Hfe Contra sequence |
| Is084 | /A*CTTCATACACAACTCCCGCG TTGCATAACT/iSpC3/CCCCTGGG GAAGAGCAGAGATATATGT*G/ (SEQ ID NOS 2 & 9) | Wt C282 SNP discriminating primer with Sc complement |
| Is085 | /G*CGGCGCGATGCGCCACCTGC CGC/iSpC3/CCCCTGGGGAAGAGC AGAGATTTACGT*A/ (SEQ ID NOS 3 & 10) | Mut Y282 SNP discriminating primer with anti-MBW complement |
| Is071 | amino_modifier_C12-T20- GCGGCAGGTGGCGCATCGCGCC GC (SEQ ID NO: 4) | MBW capture |
| Is028.L2 | amino_modifier_C12-T20- AGTTATGCAACGCGGGAGTTGT GTATGAAGT (SEQ ID NO: 5) | Sc Capture with anti-Sc |

Designations: 5Bio—5'-biotinylated base; iBiodT—internal dT biotinylated base;*—phosphorothiolate backbone; T20-20 dTs in the sequence; Amino_modifier_C12—5' amino derivative; iSpC3—spacer/blocker phosphoramidite; Hfe—Hemachromatosis gene, Wt—wild type, Mut—mutant; SNP—single nucleotide polymorphism; MBW selected sequence; Sc selected sequence.

In a preferred embodiment, the detection device (also referred to as a universal detection cartridge or UDC) is manufactured with two biosensors with detectable sequences for MBW and Sc. In independent reactions, oligonucleotides is071 and is028.L2 are added to carboxylated beads and chemically linked using EDAC via techniques well known to those skilled in the art. These beads are printed on wafers at two independent locations that are manufactured with gold metal sensors using techniques described in, for example, jointly-owned U.S. Application Publication No. 2003/0170881 (the '881 application), the entire contents of which are incorporated by reference herein. In addition to the beads bound with capture synthetic oligonucleotides, another print on the same chip includes a streptavidin-alkaline phosphatase conjugate. The wafers are diced and chips assembled along with an Ag/AgCl reference chip into detection devices of the type described in the '881 application. The fluidic elements of these detection devices are similar in format to commercial blood testing cartridges sold by, for example, i-STAT Corporation for measuring cardiac troponin I (cTnI).

In the present example, a sample of human buccal cells is scraped onto the end of a swab that is assembled into the amplification chamber 11. The amplification mixture, which is described below, is then pushed into the amplification chamber 11. As described above, the amplification chamber 11 is sealed by applying pressure to the pins 53, 57 at the ingress 12 and egress 14 ports, respectively. The amplification chamber 11 is first heated to about 97° C. for about 45 seconds and then cycled between about 68° C. and about 90° C. for approximately thirty five cycles. The time duration at each temperature is preferably more than 5 and less than 30 seconds, respectively. In a preferred exemplary embodiment, the buffer comprises 22 U/ml *Thermococcus* species KOD thermostable polymerase complexed with anti-KOD antibodies, 66 mM Tris-SO4 (pH 8.4), 30.8 mM $(NH4)_2SO4$, 11 mM KCl, 1.1 mM MgSO4, 330 uM dNTPs, as well as proteins and stabilizers (e.g., Invitrogen Life Technologies AccuPrime Pfx SuperMix manual, Cat. No. 12344-040). A suitable alternative exemplary embodiment can comprise 20 mM Tris-HCL (pH 8.8), 2 mM MgSO4, 10 mM KCl, 10 mM $(NH4)_2SO4$, 0.1% Triton-X-100, and 0.1 mg/ml nuclease-free BSA (e.g., Stratagen Pfu DNA polymerase Instruction Manual Cat #600135 Revision$ 064003d). Primers is083, is084 and is085 can also be present in the reaction at approximately 7.5 pmol total.

After the amplification cycle, the pins 53, 57 are released and a pin over the air bladder is pushed to move the sample into the detection device 59. The operation of the detection device 59 has been previously described in, for example, U.S. Application Publication No. 2003/0170881. A poise potential of, for example, 30 mV versus Ag/AgCl is applied to the biosensors. The amplified sample is then mixed over the top of the capture oligonucleotide beads printed over the biosensors, as described above. Amplified material with the appropriate complementary single stranded region hybridizes to one of the two printed beads with capture oligonucleotides. Additionally, the printed streptavidin-alkaline phosphatase conjugate is dissolved into this solution and it binds to the biotinylated bases on the primer sequence. After about 3 to about 10 minutes, this solution is then removed to a waste chamber in the cartridge and a solution containing an electrogenic alkaline phosphatase substrate, e.g., amino nitrophenyl phosphate (ANPP) or the like, is moved over to the region where the biosensors are located. Optionally, this solution is left in place or removed from this location, leaving a thin film of liquid over the biosensor. The amount of current generated (signal) by the conversion of the ANPP to amino nitrophenol by the alkaline phosphatase is then measured, as an indicator of the number of amplicons bound at the biosensor.

A signal at only the MBW biosensor is indicative of a mutant SNP sequence. A signal at the Sc biosensor is an indication of a wildtype SNP sequence, and a signal at both biosensors indicates that the patient sample is heterozygous for that SNP sequence. It will be recognized that when no signal is generated at both biosensors, it is an indication of an error occurring in either the amplification or detection process.

Example 2

PCR Amplification of Phenylthiocarbamide (PTC) allele 1 and detection [TAS2R38, Ala49Pro]

| Oligo designation | Sequence (5'->3') | Characteristics |
|---|---|---|
| Is095 | /A*CTTCATACACAACTCCCGCGTT GCATAACT/iSp18/GGTGAATTTTTG GGATGTAGTGAAGAGGTAG*G/ (SEQ ID NOS 6 & 11) | PTC1 wt with Sc complementary sequence |
| Is096 | /G*CGGCGCGATGCGCCACCTGCC GC/iSp18/GGTGAATTTTTGGGATG TAGTGAAGAGTCAG*C/ (SEQ ID NOS 7 & 12) | PTC1 mut with MBW complementary region |
| Is101 | /5Bio/T*GG/iBioT/CGGCTCTTACCT TCAGGCT*G/ (SEQ ID NO: 8) | PTC contra sequence with biotinylated nucleotides |
| Is071 | amino_modifier_C12-T20-GCGGCAGGTGGCGCATCGCGCCG C (SEQ ID NO: 4) | MBW capture |
| Is028.L2 | amino_modifier_C12-(T)20-AGTTATGCAACGCGGGAGTTGTG TATGAAGT (SEQ ID NO: 5) | Sc Capture with anti-Sc |

Designations: 5Bio—5'-biotinylated base; iBiodT—internal dT biotinylated base;*—phosphorothiolate backbone; T20—20 dTs in the sequence; Amino_modifier_C12—5' amino derivative; PTC—phenylthiocarbamide gene, Wt—wild type, Mut—mutant; SNP—single nucleotide polymorphism; MBW—selected sequence; Sc—selected sequence.

In a preferred exemplary embodiment, the detection device 59 is manufactured with two biosensors with detectable sequences for MBW and Sc. In independent reactions, oligonucleotides is071 and is028.L2 are added to carboxylated beads and chemically linked using EDAC using techniques described above. These beads are printed on wafers at two independent locations that are manufactured with gold metal sensors using techniques as described above. In addition to the beads bound with capture synthetic oligonucleotides, another print on the same chip contains a streptavidin-alkaline phosphatase conjugate. The wafers are diced and assembled into detection devices 59, along with an Ag/AgCl reference chip, as described above.

A human buccal sample is scraped onto the end of a swab that is assembled into the amplification chamber 11. The amplification mixture (described below) is pushed into the amplification chamber 11. The amplification chamber 11 is sealed by applying pressure to the pins 53, 57 at the ingress 12 and egress 14 ports, respectively, and then heated to about 97° C. for approximately 45 seconds. The amplification chamber 11 is then cycled between about 68° C. and about 90° C. for approximately thirty five cycles. The time duration at each temperature is preferably more than 5 and less than 30 seconds, respectively. In a preferred exemplary embodiment, the buffer comprises 22 U/ml *Thermococcus* species KOD thermostable polymerase complexed with anti-KOD antibodies, 66 mM Tris-SO4 (pH 8.4), 30.8 mM (NH4)2SO4, 11 mM KCl, 1.1 mM MgSO4, 330 uM dNTPs, as well as proteins and stabilizers (e.g., Invitrogen Life Technologies AccuPrime Pfx SuperMix manual, Cat. No. 12344-040). An alternatively exemplary embodiment can use 20 mM Tris-HCL (pH 8.8), 2 mM MgSO4, 10 mM KCl, 10 mM $(NH4)_2SO4$, 0.1% Triton-X-100, 0.1 mg/ml nuclease-free BSA (e.g., Stratagen Pfu DNA polymerase Instruction Manual Cat #600135 Revision$ 064003d), and/or the like. Primers is095, is096 and is101 can also be present in the reaction to approximately 7.5 pmol final.

After the amplification cycle, the pins 53, 57 are released and a pin over the air bladder is pushed to move the sample into the detection device 59. The analysis is performed in the same manner as described for Example 1. The amount of current generated (signal) is then measured as an indication of the number of amplicons bound at the biosensor. A signal at only the MBW biosensor is a mutant SNP sequence. A signal at the Sc biosensor is an indication of a wildtype SNP sequence, and a signal at both biosensors indicates that the patient is heterozygous for that SNP sequence. As mentioned above, when no signal is generated at both biosensors, it is an indication of an error occurring in either the amplification or detection process.

Figure 11:
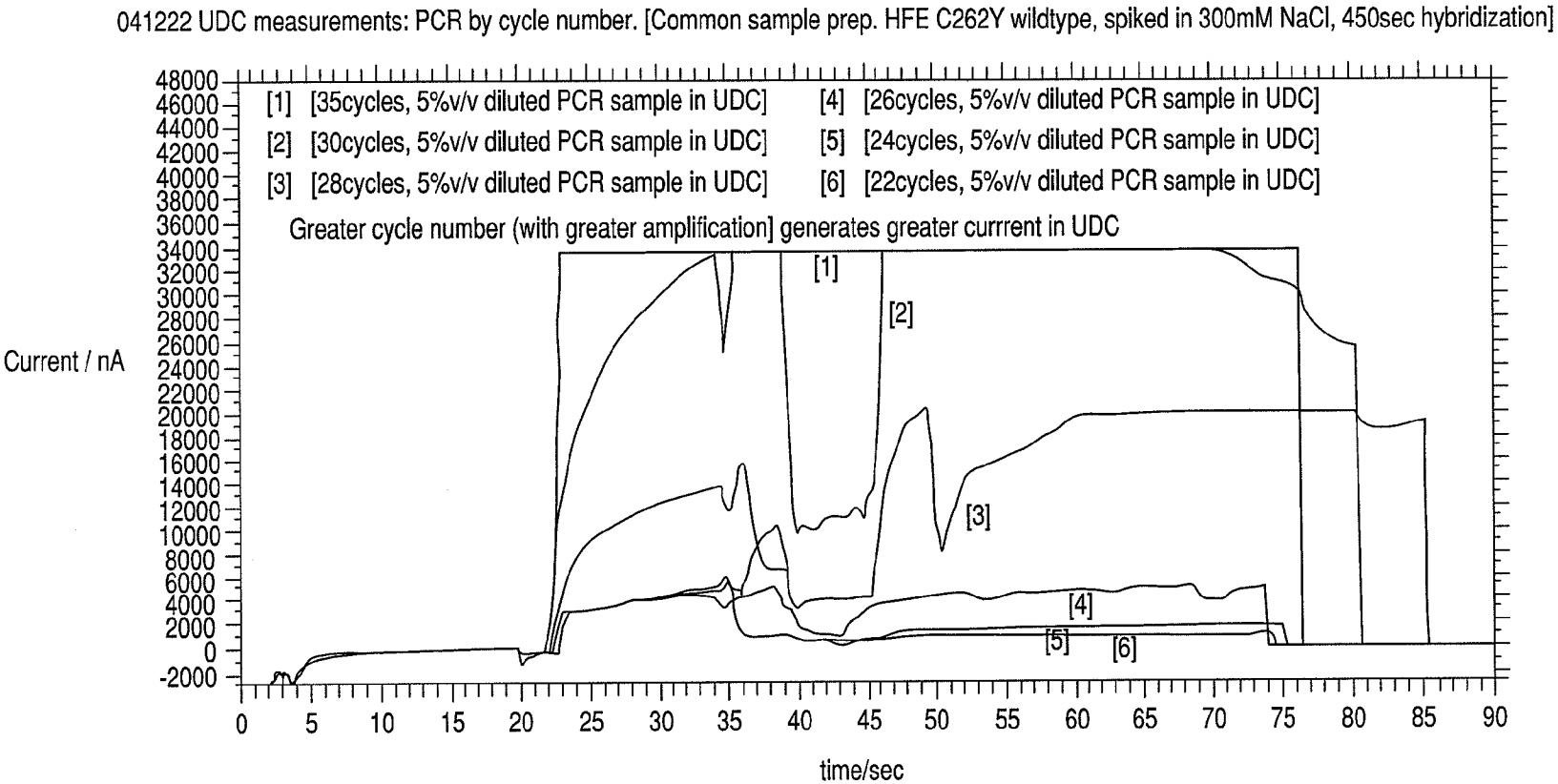
FIG. 11 illustrates a typical chronoamperometry output for PCR with target gene 1 after 22, 24, 26, 28, 30 and 35 PCR amplification cycles in the amplification device, in accordance with an exemplary embodiment of the present invention.

FIG. 11 illustrates the measured current profiles, termed chronoamperometric outputs, from the DNA cartridges, and specifically for the detection device 59. In the present example, PCR is performed in an Eppendorf Mastercycler epgradient S, SN534502285. The PCR reaction was using primers described above specific for human C282Y SNP differentiation and used human DNA from a wild-type donor. The reactions were performed for 20, 22, 24, 26, 28, 30 and 35 cycles, prior to testing. An aliquot comprising 5% of the material from the amplification reaction was used in the detection device 59, generating the chronoamperometric data seen in FIG. 11.

The software for the instrument used for detection can be based on modified i-STAT 300 analyzer software (i-STAT Corporation, East Windsor, N.J.) that performs a series of steps in the detection process, although other suitable software processes or techniques can be used to implement the appropriate features and functionality of the instrument used for detection. The detection cartridge 59 is described in, for example, jointly-owned U.S. Application Publication No. 2003/0170881, the entire contents of which are incorporated by reference. Liquid containing the amplified target from the amplification cartridge is pneumatically pushed into the sensor chamber of the detection cartridge 59 to permit the capture steps. In a preferred exemplary embodiment, the temperature of a sensor chip in the detection cartridge 59 is set to approximately 47° C. as fluid containing amplicon is pushed back and forth over top of the capture oligonucleotide beads on the sensor to affect efficient capture of the amplicon. This step takes about 3 to about 10 minutes. Any liquid containing the uncaptured amplicon is then moved from the sensor area to a waste chamber, and a wash fluid containing an electroactive substrate is then applied to the sensor and set to collect data at a poise potential of, for example, +30 mV vs. Ag/AgCl electrode (at 2 pA/bit). The wash fluid is also forced into a waste chamber leaving a thin layer of analysis fluid containing p-aminophenol phosphate that can react with the enzyme on the amplicon and be oxidized at the electrodes. Current generated as a function of time is recorded, as illustrated in FIG. 11.

In an alternative exemplary embodiment where the moiety is biotin and is bound to streptavidin-labeled alkaline phosphatase, the detection reagent can be p-aminophenol phosphate that is hydrolysed to form p-aminophenol by the enzyme. This is then electrochemically oxidized at the electrode surface of an amperometric sensor to generate a current proportional to the amount of moiety that is present. As mentioned above, this type of detection is illustrated in the current versus time plots of FIG. 11.

The instrument used for detection preferably includes a keypad for user entries and a suitable display. The instrument also includes a power source and suitable electrical and/or electronic circuitry and an embedded algorithm for controlling the temperature of the amplification chamber, as will be apparent to those skilled in the art. The instrument can also include an electrical connector of the type described in, for example, jointly-owned U.S. Pat. Nos. 4,954,087 and 5,096,669. The electrical connector can be used to make electrical connection to the sensors. Where it is desirable to perform the detection step at a controlled temperature, e.g., 37° C. or other suitable temperature, the connector can also incorporate suitable heating and thermistor elements that contact the back side of the silicon chip that provides the substrate for the sensor. These elements are of the same type as described for the amplification chamber 11. The instrument includes amperometric circuitry for controlling the potential of the sensor and measuring current. The instrument also includes a suitable embedded algorithm for controlling the entire analysis sequence performed by the instrument on the single-use device to make a nucleic acid determination and display a result on a display screen on the instrument. Where the electroactive species generated or consumed in proportion to the captured target is more appropriately detected by means of potentiometry or conductimetry, alternative circuitry (well known in the art) can be incorporated into the instrument.

While a preferred method of detection in the single-use cartridge is electrochemical, other sensing methods, including, but not limited to, fluorescence, luminescence, calorimetric, thermometric, fiber optics, optical wave guides, surface acoustic wave, evanescent wave, plasmon resonance and the like, can be used.

A preferred sensor comprises an amperometric electrode that is operated with a counter-reference electrode. The amperometric electrode comprises an approximately 100 um diameter gold layer microfabricated onto a silicon chip. The silicon chip is treated in the first step of manufacture to produce an insulating layer of silicon dioxide on the surface, as is well known in the art. The electrode can be connected by means of a conducting line to a connector pad that makes contact with the electrical connector of the instrument. The conducting line is typically coated with an insulating layer of polyimide. Directly over the electrode or at an adjacent location on the chip are adhered polymer particles that have a ligand complimentary to and capable of capturing the amplified target. The counter-reference electrode can be microfabricated on the same silicon chip or one place adjacently in the second conduit. The counter-reference electrode can comprise a silver-silver chloride (Ag/AgCl) layer, of about 200 μm diameter, attached by a contact line to a contact pad that makes contact with the instrument connector. Again, the line is preferably coated with an insulating layer of polyimide. A detailed description of amperometric sensor microfabrication can be found in, for example, jointly-owned U.S. Pat. No. 5,200,051, the entire contents of which are incorporated by reference.

The measured current is used by the instrument to determine the presence or absence of the suspected target nucleic acid in the original sample. This may be a qualitative result, or, where the target is present, a quantitative determination of the amount of target in the sample. An algorithm for a particular target factors the original sample volume entering the extraction chamber, the number and efficiency of amplification cycles and the efficiency of the capture reaction along with any other necessary factors to determine the original concentration of the target in the sample. Such factors are independently determined using known samples from a reference method. These methods are well known in the art.

The overall time for the assay, from sample entry into the amplification single-use device to results determined by the detection cartridge, takes between about 10 and about 30 minutes, preferably less than 20 minutes. The overall time generally depends on the specific target and the required number of amplification cycles.

A significant advantage of the disclosed device and instrument combinations is that once the sample has entered the device, all other steps are controlled by the instrument, thus eliminating possible human error in the test cycle. Consequently, the system can be used reliably by those not specifically skilled in analytical laboratory measurement. For example, a physician can use the system at the bedside or during a patient's office visit. The instrument is also portable, and can be battery-powered or solar-powered. As a result, the system can also be used at remote locations, such as, for example, in environmental monitoring and hazard assessment. An added benefit of the design of the present invention is that it also retains sample residue and amplified material within the device for safer disposal.

Various other embodiments and configuration are within the scope of the invention. For example, an instrument according to exemplary embodiments can have all the actuation and electrical connection elements in a single port with which the amplification and detection features of the cartridge mate. Alternatively, one port on an instrument can operate the amplification steps, after which the device is inserted into a second port for the detection steps. Such a second port can be on the same or a different instrument. Optionally, the transfer of amplicon from the amplification component to the detection component can be manually actuated, although such a step is preferably under instrument control. An alternative embodiment of the detection step can be based on optical detection and real-time PCR. In such an alternatively exemplary embodiment, the amplification chamber can include an optical window to permit real-time PCR measurement with optical detection. Reagents and methods for real-time PCR are well known in the art.

The examples presented herein are merely illustrative of various embodiments of the invention and are not to be construed as limiting the present invention in any way. It will be appreciated by those of ordinary skill in the art that the present invention can be embodied in various specific forms without departing from the spirit or essential characteristics thereof. The presently disclosed embodiments are considered in all respects to be illustrative and not restrictive. The scope of the invention is indicated by the appended claims, rather than the foregoing description, and all changes that come within the meaning and range of equivalence thereof are intended to be embraced.

All United States patents and applications, foreign patents and applications, and publications discussed above are hereby incorporated by reference herein in their entireties.

SEQUENCE LISTING

```
<160> NUMBER OF SEQ ID NOS: 12

<210> SEQ ID NO 1
<211> LENGTH: 25
<212> TYPE: DNA
<213> ORGANISM: Artificial Sequence
<220> FEATURE:
<223> OTHER INFORMATION: Description of Artificial Sequence:  Synthetic
      oligonucleotide
<220> FEATURE:
<221> NAME/KEY: modified_base
<222> LOCATION: (1)
<223> OTHER INFORMATION: biotinylated-c
<220> FEATURE:
<221> NAME/KEY: misc_feature
<222> LOCATION: (1)..(2)
<223> OTHER INFORMATION: phosphorothiolate backbone
<220> FEATURE:
<221> NAME/KEY: modified_base
<222> LOCATION: (6)
<223> OTHER INFORMATION: biotinylated-t
<220> FEATURE:
<221> NAME/KEY: misc_feature
<222> LOCATION: (24)..(25)
<223> OTHER INFORMATION: phosphorothiolate backbone

<400> SEQUENCE: 1

ccagatcaca atgaggggct gatcc                                          25


<210> SEQ ID NO 2
<211> LENGTH: 31
<212> TYPE: DNA
<213> ORGANISM: Artificial Sequence
<220> FEATURE:
<223> OTHER INFORMATION: Description of Artificial Sequence:  Synthetic
      oligonucleotide
<220> FEATURE:
<221> NAME/KEY: misc_feature
```

<222> LOCATION: (1)..(2)
<223> OTHER INFORMATION: phosphorothiolate backbone

<400> SEQUENCE: 2 acttcataca caactcccgc gttgcataac t 31

<210> SEQ ID NO 3
<211> LENGTH: 24
<212> TYPE: DNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: misc_feature
<222> LOCATION: (1)..(2)
<223> OTHER INFORMATION: phosphorothiolate backbone

<400> SEQUENCE: 3 gcggcgcgat gcgccacctg ccgc 24

<210> SEQ ID NO 4
<211> LENGTH: 44
<212> TYPE: DNA
<213> ORGANISM: Artificial Sequence
<220> FEATURE:
<223> OTHER INFORMATION: Description of Artificial Sequence: Synthetic
oligonucleotide

<400> SEQUENCE: 4 tttttttttt tttttttttt gcggcaggtg gcgcatcgcg ccgc 44

<210> SEQ ID NO 5
<211> LENGTH: 51
<212> TYPE: DNA
<213> ORGANISM: Artificial Sequence
<220> FEATURE:
<223> OTHER INFORMATION: Description of Artificial Sequence: Synthetic
oligonucleotide

<400> SEQUENCE: 5 tttttttttt tttttttttt agttatgcaa cgcgggagtt gtgtatgaag t 51

<210> SEQ ID NO 6
<211> LENGTH: 31
<212> TYPE: DNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: misc_feature
<222> LOCATION: (1)..(2)
<223> OTHER INFORMATION: phosphorothiolate backbone

<400> SEQUENCE: 6 acttcataca caactcccgc gttgcataac t 31

<210> SEQ ID NO 7
<211> LENGTH: 24
<212> TYPE: DNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: misc_feature
<222> LOCATION: (1)..(2)
<223> OTHER INFORMATION: phosphorothiolate backbone

<400> SEQUENCE: 7 gcggcgcgat gcgccacctg ccgc 24

<210> SEQ ID NO 8
<211> LENGTH: 24
<212> TYPE: DNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: modified_base
<222> LOCATION: (1)
<223> OTHER INFORMATION: biotinylated-t
<220> FEATURE:
<221> NAME/KEY: misc_feature
<222> LOCATION: (1)..(2)
<223> OTHER INFORMATION: phosphorothiolate backbone
<220> FEATURE:
<221> NAME/KEY: modified_base
<222> LOCATION: (4)
<223> OTHER INFORMATION: biotinylated-t
<220> FEATURE:
<221> NAME/KEY: misc_feature
<222> LOCATION: (23)..(24)
<223> OTHER INFORMATION: phosphorothiolate backbone

<400> SEQUENCE: 8 tggtcggctc ttaccttcag gctg 24

<210> SEQ ID NO 9
<211> LENGTH: 28
<212> TYPE: DNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: misc_feature
<222> LOCATION: (27)..(28)
<223> OTHER INFORMATION: phosphorothiolate backbone

<400> SEQUENCE: 9 cccctgggga agagcagaga tatatgtg 28

<210> SEQ ID NO 10
<211> LENGTH: 28
<212> TYPE: DNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: misc_feature
<222> LOCATION: (27)..(28)
<223> OTHER INFORMATION: phosphorothiolate backbone

<400> SEQUENCE: 10 cccctgggga agagcagaga tttacgta 28

<210> SEQ ID NO 11
<211> LENGTH: 32
<212> TYPE: DNA
<213> ORGANISM: Artificial Sequence
<220> FEATURE:
<223> OTHER INFORMATION: Description of Artificial Sequence: Synthetic
oligonucleotide
<220> FEATURE:
<221> NAME/KEY: misc_feature
<222> LOCATION: (31)..(32)
<223> OTHER INFORMATION: phosphorothiolate backbone -continued

```
<400> SEQUENCE: 11

ggtgaatttt tgggatgtag tgaagaggta gg                                  32


<210> SEQ ID NO 12
<211> LENGTH: 32
<212> TYPE: DNA
<213> ORGANISM: Artificial Sequence
<220> FEATURE:
<223> OTHER INFORMATION: Description of Artificial Sequence:  Synthetic
      oligonucleotide
<220> FEATURE:
<221> NAME/KEY: misc_feature
<222> LOCATION: (31)..(32)
<223> OTHER INFORMATION: phosphorothiolate backbone

<400> SEQUENCE: 12

ggtgaatttt tgggatgtag tgaagagtca gc                                  32
```

What is claimed is:

1. A nucleic acid amplification device comprising:

a housing; and an amplification chamber comprising:

an ingress with a first reversible seal;

an egress with a second reversible seal;

a sealable sample entry orifice; and a first wall forming a portion of the amplification chamber, wherein the first wall comprises a thermally conductive material and includes a first surface and a second surface, wherein the second surface includes a heating circuit and a temperature sensor, wherein the sample entry orifice permits a sample of nucleic acid to enter the amplification chamber, wherein the ingress is connected to a first conduit along with a reservoir comprising a first flexible diaphragm and a fluid pouch for performing nucleic acid amplification, and a pump comprising a pneumatic pump and a second flexible diaphragm, wherein the first flexible diaphragm is configured to engage and be actuated by a plunger on an instrument with which the amplification device is configured to mate, wherein the second flexible diaphragm is configured to engage and be actuated by a plunger on an instrument with which the amplification device is configured to mate, and wherein the egress is connected to a second conduit permitting egress of an amplicon from the amplification chamber.

2. The amplification device of claim 1, wherein the first wall comprises silicon and wherein the silicon comprises about 30 to about 50 percent of the first surface area of the amplification chamber.

3. The amplification device of claim 2, wherein the sample entry orifice is configured to mate with a sample introduction element comprising a wand.

4. The amplification device of claim 1, wherein the amplification chamber includes a second wall comprising a plastic material.

5. The amplification device of claim 4, wherein the second wall comprises a wall thickness in the range of about 0.2 mm to about 5 mm, and wherein the second wall includes one or more additional rib supports.

6. The amplification device of claim 1, wherein an internal volume of the amplification chamber is in the range of about 5 uL to about 50 uL.

7. The amplification device of claim 1, wherein an amplification chamber surface to an amplification chamber volume ratio is in the range of about 50 to about 200 square mm for the amplification chamber surface and to about 5 to about 30 cubic mm for the amplification chamber volume.

8. The amplification device of claim 1, wherein an internal shape of the amplification chamber comprises one of a substantially rectangular structure, a substantially rectangular shape with rounded corners, a cylinder, and a cylindrical structure with a substantially oval cross-section.

9. The amplification device of claim 1, wherein the second surface of the first wall comprises a heating circuit.

10. The amplification device of claim 9, wherein the heating circuit comprises a resistive electrical path fabricated on the second surface with a first and second connecting pad for contacting an external circuit for providing current flow through the path.

11. The amplification device of claim 1, wherein the second surface of the first wall comprises a temperature sensor and wherein the temperature sensor comprises one of a thermistor and a thermocouple fabricated on the second surface with a first and second connecting pad for contacting an external circuit for connecting to the one of the thermistor and the thermocouple.

12. The amplification device of claim 1, wherein the amplification chamber comprises a sugar glass coating on at least a portion of the first surface of the first wall.

13. The amplification device of claim 1, wherein the amplification chamber is configured to have a temperature increase ramp rate in the range of about 10 to about 50 degrees centigrade per second.

14. The amplification device of claim 1, wherein the amplification chamber is configured to have a temperature decrease ramp rate in the range of about 4 to about 50 degrees centigrade per second.

15. The amplification device of claim 1, wherein the amplification chamber comprises an optical window.

16. The amplification device of claim 1, wherein the second surface of the first wall comprises a Peltier circuit with a first and second connecting pad for contacting an external circuit.

17. The amplification device of claim 1, wherein the first reversible seal comprises a flexible diaphragm.

18. The amplification device of claim 1, wherein the second conduit comprises a mating feature for engaging a device for detection of the amplicon.

19. The amplification device of claim 1, wherein the first conduit comprises a chip insert with a fluid detection sensor.

* * * * *